US005659842A

United States Patent [19]

Hasegawa et al.

[11] Patent Number: 5,659,842

[45] Date of Patent: Aug. 19, 1997

[54] IMAGE FORMING APPARATUS

[75] Inventors: Takashi Hasegawa, Ageo; Masahiro Inoue, Yokohama; Nobuhiko Takekoshi, Tokyo; Yoichi Kimura, Yokohama, all of Japan

[73] Assignee: Canon Kabushiki Kaisha, Tokyo, Japan

[21] Appl. No.: 69,384

[22] Filed: Jun. 1, 1993

[30] Foreign Application Priority Data

May 29, 1992 [JP] Japan ..... 4-161688
May 29, 1992 [JP] Japan ..... 4-161689

[51] Int. Cl.[6] ..... G03G 15/14

[52] U.S. Cl. ..... 399/66; 399/303

[58] Field of Search ..... 355/271, 274, 355/277, 326, 327; 399/66, 303

[56] References Cited

U.S. PATENT DOCUMENTS

| | | | |
|---|---|---|---|
| 3,147,679 | 9/1964 | Schaffert | 95/1.7 |
| 4,162,843 | 7/1979 | Inoue et al. | 355/326 X |
| 4,559,509 | 12/1985 | Mayer | 355/274 X |
| 4,843,423 | 6/1989 | Nakamura et al. | 355/245 |
| 4,888,621 | 12/1989 | Ohno | 355/326 |
| 5,027,152 | 6/1991 | Oda et al. | 355/200 |
| 5,041,877 | 8/1991 | Matsumoto | 355/271 |
| 5,083,167 | 1/1992 | Fukushima et al. | 355/274 |
| 5,084,737 | 1/1992 | Hagen et al. | 355/274 |
| 5,086,318 | 2/1992 | Takeda et al. | 355/271 |
| 5,172,173 | 12/1992 | Goto et al. | 355/275 |
| 5,182,604 | 1/1993 | Asai | 355/273 |
| 5,187,536 | 2/1993 | Hasegawa et al. | 355/327 |
| 5,198,864 | 3/1993 | Fletcher | 355/274 |
| 5,253,022 | 10/1993 | Takeuchi et al. | 355/274 |
| 5,287,144 | 2/1994 | Takeda | 355/208 |
| 5,428,429 | 6/1995 | Fletcher | 355/272 |

FOREIGN PATENT DOCUMENTS

| | | |
|---|---|---|
| 0298505 | 1/1989 | European Pat. Off. . |
| 55-029851 | 3/1980 | Japan . |
| 63-118780 | 5/1988 | Japan . |
| 4-098278 | 3/1992 | Japan . |

*Primary Examiner*—William J. Royer
*Attorney, Agent, or Firm*—Fitzpatrick, Cella, Harper & Scinto

[57] ABSTRACT

An image forming apparatus includes an image bearing member; recording material carrying member for carrying a recording material; a transfer charging member for transferring a toner image formed on the image bearing member onto the recording material carried on the recording material carrying member; a controller for controlling an electric current supplied from the transfer charger to the recording material carrying member to be a predetermined level; and potential applying device for applying a potential of the same polarity as that of the toner image to a backside of the recording material carrying member prior to transfer operation of the transfer charger.

26 Claims, 35 Drawing Sheets

IMAGE FORMING APPARATUS

FIELD OF THE INVENTION AND RELATED ART

The present invention relates generally to an image forming apparatus of an electrophotographic type or an electrostatic recording type. More particularly, it is preferably impremented in a color image forming apparatus such as a multi-color electrophotographic machine or a color printer, for example, wherein a recording material is attracted and held electrostatically on a recording material carrying member such as a transfer sheet, and visualized images (toner images) formed on an image bearing member are superposedly transferred onto this recording material by application of the electric field to this recording material, and it provides a color image.

Referring to FIG. 24, there is shown a conventional digital full-color electrophotographic copying machine as an example of the color image forming apparatus. In this example, the image bearing member in the form of a photosensitive drum is rotated in a direction indicated by an arrow, and it is uniformly charged by a charger 2.

Subsequently, an image exposure operation is carried out by a laser beam E modulated in accordance with an image signal of an original (not shown), and an electrostatic latent image is formed on the photosensitive drum 1.

A first color development is effected by a predetermined developer of a rotary type developing device 3, positioned to a developing position beforehand, into a toner image. This toner image is transferred to a recording material, which has been fed from a recording material cassette (not shown), and such an image formation process is repeated a predetermined number of times on the recording material carried on the transfer drum 8, so that a color image is formed on the recording material 6.

Referring to FIG. 24, the description will be made particularly as to a high voltage source, and associated members around the transfer drum 8, and the operation in such a color copying machine.

An inside discharger 15 and an outside discharger 14 operate first prior to the above-described copying operation. High voltage sources HV6 and HV5 connected to the inside discharger 15 and the outside discharger 14, are both AC voltage sources, and the recording material carrying member 81, that is, a transfer sheet, which carries and conveys the recording material 6 wrapped around the circumference outside the transfer drum 8, is discharged to approximately 0 V.

Subsequently, when the feeding of the recording material 6 is started, an attraction charger 10*a* is operated by a high voltage source HV1. In this case, the voltage source HV1 has the same polarity as the polarity of a transfer charger 4, which will be described hereinafter. At this time, an opposite roller 10*b* contacts the surface of the recording material 6 and the recording material 6 is attracted to the transfer sheet 81.

Subsequently, when the recording material 6 is conveyed to the transfer position, the transfer charger 4 starts the discharge operation by a high voltage source HV2, to transfer the first color toner image.

Then, when the second to fourth color toner images are transferred with the rotation of the transfer drum 8, the recording material 6 is separated from the transfer drum 8 by separation claws 18. In that case, the inside discharger 15 and the outside discharger 14 operate to discharge the transfer sheet 81.

In this conventional example, a proposal has been made in which the bias of the opposite polarity from the transfer charger 4 is applied to the attraction charger 10*a*. Additionally, as another prior art, Japanese Laid-Open Patent Application No. 118780/1988, which has been assigned to the assignee of this application, has made a proposal in which by a full-color copying machine using a transfer belt as shown in FIG. 25, the discharge of the transfer belt 8 and the attraction of the recording material 6, are simultaneously effected. As shown in FIG. 26, at the attracting position, an AC bias source 80 is connected with a corona discharger 59, and an AC bias source 8 and a DC bias voltage source 82 are connected with a corona discharger 62 which faces thereto.

In the structure shown in FIG. 24, when the same polarity bias voltage as the transfer charger 4 is applied to the attraction charger 10*a*, the transfer sheet 81, as the case may be, is charged up upon the superpose transfer, and particularly the fourth color transfer becomes improper.

In order to avoid this problem, a recording material carrying member having a lower resistance is required to be used, and therefore, the usable material is limited. On the contrary, if the bias of the opposite polarity from the transfer charger 4 is applied by the attraction charger 10*a*, the problem of the above-described charge-up can be solved, but another problem that the first color transfer becomes unstable will arise. This is for the following reasons.

The description will be made referring to FIG. 27.

Generally, in the corona discharger 100, the total electric current to be discharged from the discharging wire 102 i1, is divided into a current i2 flowing into the shield plate 104 and the current i3 injecting into the member to be charged 106. That is, $i1=i2+i3$.

Moreover, $\rho$ is defined as a charging efficiency, where $\rho=i3/i1$.

The value $\rho$ is significantly influenced by the ambience and a surface potential (VS) of the member to be charged 106. For example, the description will be made in the case in which the high voltage source HV carries out the discharge of the positive polarity. It is assumed that the efficiency $\rho$ when VS is positive charge is $\rho+$, and the efficiency $\rho$ when the VS is negative charge is $\rho-$, the relation $\rho+<\rho-$ is satisfied. In other words, the charging efficiency is larger when the member to be charged 106 is charged to the polarity opposite from the polarity which is going to discharge. However, when there is ambient condition variation or the like, the amount of the electric charge to be injected is large by nature, and therefore, the variation will increase. Additionally, in the case of the full color copying machine in which the transfer belt 8 shown in FIG. 25 is used, the simultaneous discharge and attraction charge will be a countermeasure against the cost increase. However, the problem of the charge up and the problem of the instability of the first color transfer are not solved, although it depends also on the polarity of DC bias to be superimposed.

SUMMARY OF THE INVENTION

An object of the present invention is to provide an image forming apparatus, wherein a problem of the charge up of the recording material carrying member attributable to the transfer is solved.

Another object of the present invention is to provide an image forming apparatus wherein a stabilized transfer efficiency is always provided.

It is a further object of the present invention to provide an image forming apparatus wherein the range of selection of the material of the recording material carrying member is expanded.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The image forming apparatus of the present invention will be described in detail in accordance with the accompanying drawings.

Embodiment 1

Figure 1:
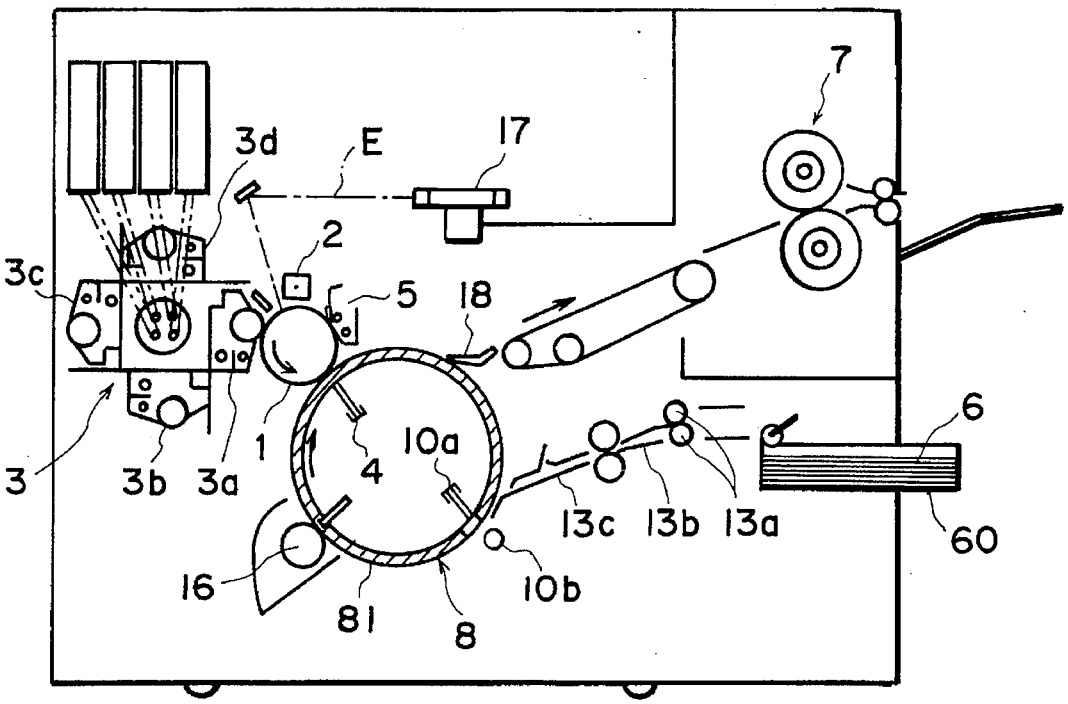
FIG. 1 is an illustration of an image forming apparatus according to a first embodiment of the present invention.

FIG. 1 is an illustration of an image forming apparatus according to a first embodiment of the present invention, and the present invention is applied to a digital full-color electrophotographic copying machine, here.

Referring to FIG. 1, an operation of this copying machine will be described. An image bearing member in the form of a photosensitive drum is rotated in a direction indicated by an arrow, by which it is uniformly charged by a charger 2. Subsequently, the image exposure is carried out by a laser beam E through an exposure device 17 modulated by an image signal of an original (not shown), so that an electrostatic latent image is formed on the photosensitive drum 1.

The latent image is developed (first color) by a predetermined (yellow in FIG. 1) developing device 3*a* which has been placed at a predetermined position, the developing device 3*a* is contained in a rotary type developing device having the yellow developing device 3*a*, a magenta da cyan developing 3*b*, a cyan developing device 3*c* and a black developing device 3*d*. A toner image is thus formed. The photosensitive drum is provided with a photosensitive layer and a grounded electrically conductive member which supports the photosensitive layer.

On the other hand, a recording material 6 is fed through a feeding roller 13*a*, feeding guides 13*b* and 13*c* from a recording material cassette 60, and is supplied to the transfer drum 8. At this time, an attraction roller 10*b* is pushed to the transfer drum 8 by a driving source (not shown), and in addition, substantially simultaneously, a bias voltage of the same polarity as the toner which will be described hereinafter, is applied to an attraction charging brush. In this embodiment, it is a negative bias.

By doing so, the recording material 6 is attracted on the transfer drum 8.

The transfer drum 8 is rotated in synchronism with the photosensitive drum 1 in the direction indicated by an arrow. The toner image developed by the yellow color developing device 3*a*, is transferred onto the recording material 6 by a transfer charging brush 4 in the transfer position. The transfer drum 8 continues to rotate, and it is prepared for a magenta color transfer in this embodiment.

Additionally, the photosensitive drum 1 is cleaned by a cleaning member 5. After that, it is charged again by a charger 2. It is subjected to an image exposure in the similar manner to the magenta image signal. During this period, the developing device 3 rotated so that a magenta developing device 3*b* is placed at the predetermined developing position, and it performs the magenta developing operation. The magenta toner image is transferred superposedly on the recording material 6 carried on the transfer drum 8.

Subsequently, the same operation is carried out for the cyan and black colors. When transfers for the four colors are completed to the recording material 6, this recording material 6 is separated from the transfer drum 8 by separation claws 18.

It is conveyed to a fixing device 7 by a conveyer belt. The four color toner is subjected to melting color mixture operation by the fixing device 7. Thus, a series of full-color print operations is completed, so that a full-color print image is formed.

Figure 2:
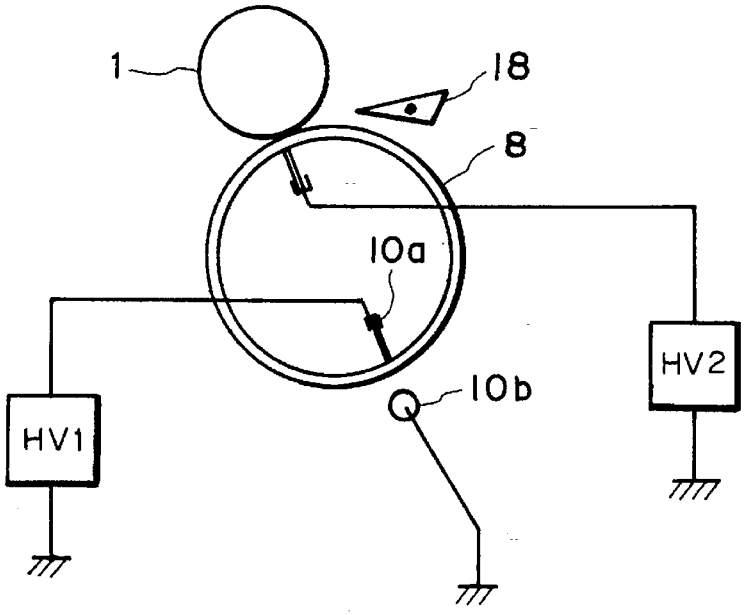
FIG. 2 is a schematic illustration of a transfer drum, a photosensitive drum and a high voltage source associated therewith or the like of the device shown in FIG. 1.

FIG. 2 is a schematic illustration of a copying machine, showing transfer drum 8, photosensitive drum 1 and a high voltage source VS associated therewith, for the apparatus of FIG. 1.

Figure 3A:
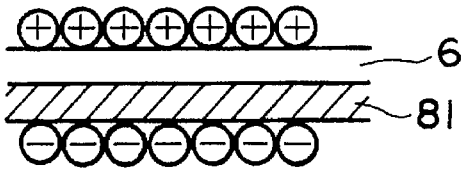
FIGS. 3A, 3B, 3C, 3D and 3E are electric charge models showing electric charging states after the superpose transfer is carried out.

When the recording material is fed so that it meets the transfer drum 8, a DC bias voltage is applied from a high voltage source HV1 to the charging brush for the attraction. The high voltage source HV1 is in the form of a constant voltage transformer and a constant voltage is applied to the brush 10*a*. An output of the voltage source HV1 is set to −3—5 KV in this embodiment. When the recording material is fed to the transfer drum 8, the attracting roller 10*b* is brought into contact to the transfer drum 8, and therefore, positive electric charge of the polarity opposite to the above-described DC bias, is induced on the surface of the recording material 6. As a result, the recording material 6 is attracted to the transfer drum 8, electrostatically. The electric charge model at this time is shown in FIG. 3A. The recording material carrying member which carries and conveys the recording material 6, namely, a transfer sheet 81 extending around the periphery of the photosensitive drum 8 in this embodiment is in the form of a dielectric sheet having a volume resistivity of no less than $10^{14}$ ohm.cm. In this embodiment, it is a film comprising carbon dispersed polycarbonate (PC), having a thickness of approx. 150 microns and volume resistivity of $3\times10^{16}$ ohm.cm.

The dielectric sheet is preferably made of high polymer material having a volume resistivity of no less than $10^{14}$ ohm.cm.

Subsequently, a first color (yellow) toner is transferred onto the recording material carried on the transfer sheet 81. At this time, the DC bias is applied from the high voltage source HV2 to the transfer discharging brush 4. The high voltage source VH2 is a constant current transformer, and a constant current is supplied to the transfer brush 4. The output of the voltage source H2 is set to approx. 15 μA in this embodiment.

Figure 3B:
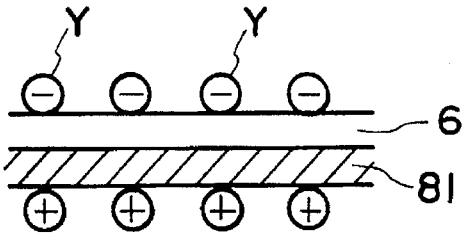

The electric charge model of the first color Y toner image after the transfer is shown in FIG. 3B. The backside of the transfer sheet 81 is charged to a positive polarity by a transfer brush 4. In addition, yellow toner (negative polarity) is transferred onto the surface of the recording material 6, and it receives negative polarity charge injection from the atmosphere, and it is stabilized.

Subsequently, the transfer of the second color M (magenta) toner is performed. Also, at this time, the DC bias is applied from HV2 to the transfer charging brush 4. In this embodiment, the output of the high voltage source HV2 is approx. 15 μA which is the same for the first color.

Figure 3C:
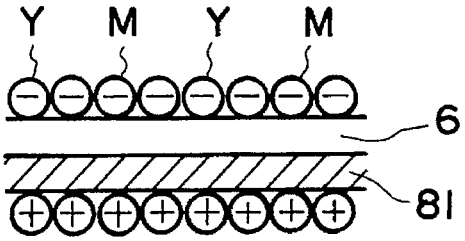

FIG. 3C shows the second color electric charge model after the transfer operation.

Figure 3D:
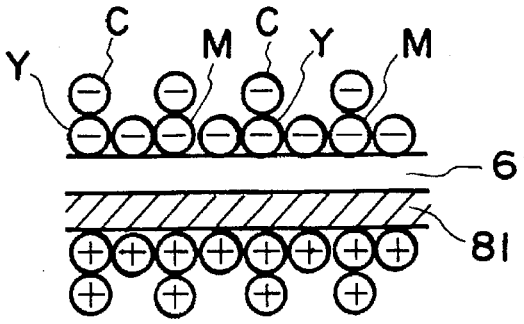
Figure 3E:
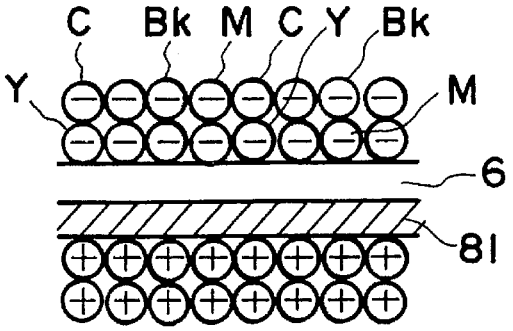

Similarly, the third color C (cyan) and fourth color Bk (black) toners are sequentially transferred. The electric charge model at this time is shown in FIGS. 3D and 3E.

As described in the foregoing, the recording material 6 which has received transfer of the toner image of four colors, is separated from the transfer drum 8 by the claws 18. On the other hand, in the case of the continuous mode copying operation, the next recording material 6 is fed immediately. The operation is the repetition of the above-described operation. Moreover, the electric charge model cycle is 3A-3B-3C-3D-3E-3A.

Figure 4:
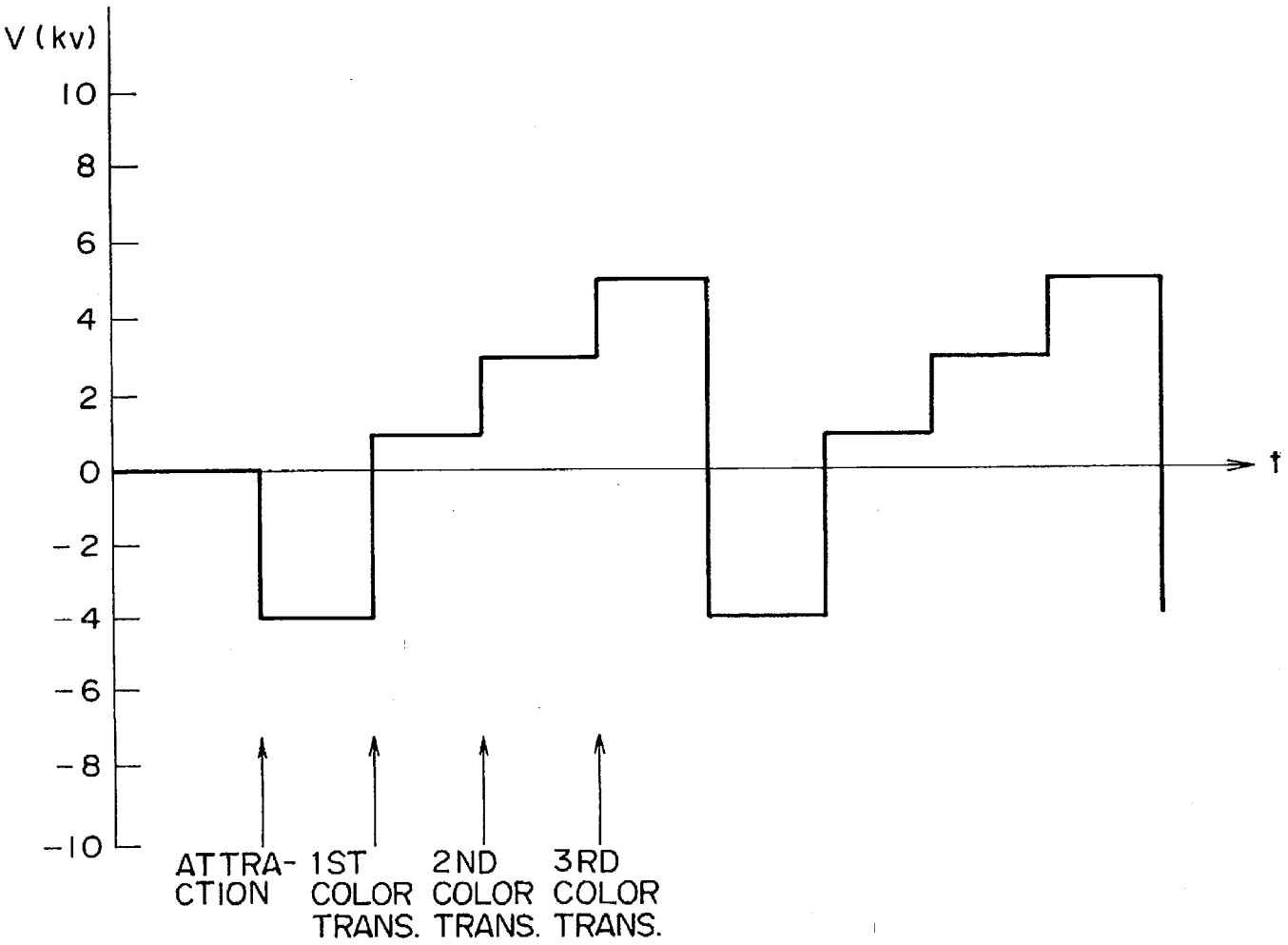
FIG. 4 shows results of measurements of the surface potential of the backside of the transfer sheet at a position downstream, with respect to the rotational direction, of the attracting position.

The inventors measured the surface potential of the backside of the transfer sheet 81 in the position downstream with respect to the rotational direction of the attracting position. The results are shown in FIG. 4, wherein the ordinate represents the surface potential of the backside of the transfer sheet 81, and the abscissa represents the period. Immediately after the attraction charge the potential of the backside of the sheet 81 is approx. −4 KV, and it is substantially the same as the bias voltage applied to the attracting charging brush 10*a*. Moreover, the above-described surface potential sequentially goes up as it applies the transfer charge for the respective colors.

As will be understood also from this results of measurement, the transfer sheet 81 is stabilized and repeatedly used without being charged up even in the continuous copy mode, by the charging at the attraction process to the polarity opposite from that of the image transfer operation. Moreover, even when the potential of the polarity opposite from that during the transfer operation is applied to the transfer sheet 81, the first color transfer is stabilized by the constant current flowing into the photosensitive drum 1 from the transfer brush 4.

Figure 5:
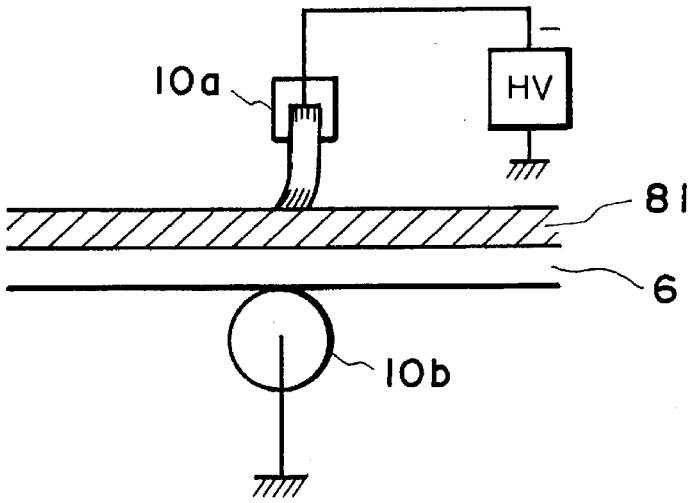
FIG. 5 shows an embodiment of attraction charging means.
Figure 6:
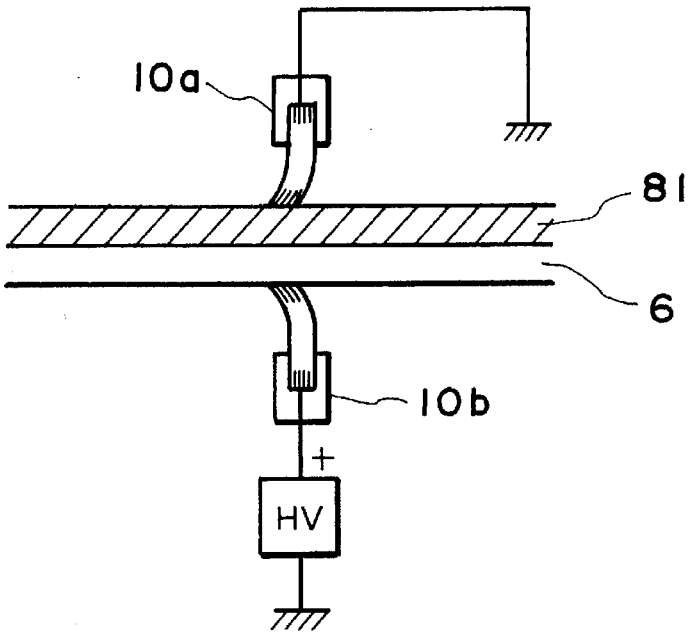
FIG. 6 shows an attraction charging member according to another embodiment.
Figure 7:
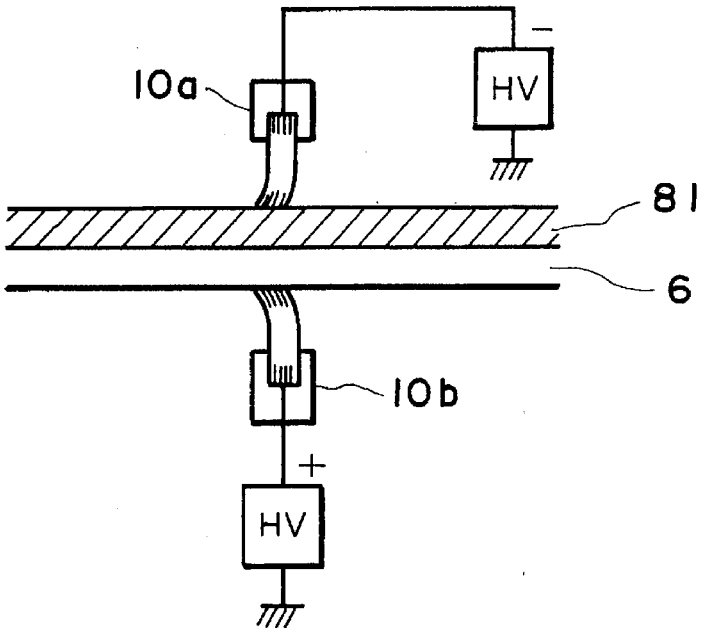
FIG. 7 shows an attraction charging means according to a further embodiment.
Figure 8:
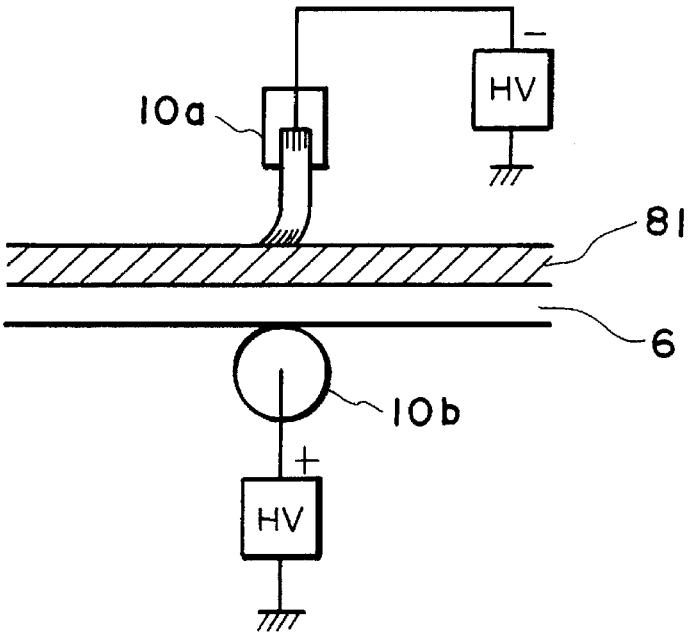
FIG. 8 shows an attraction charging means according to a further embodiment.
Figure 9:
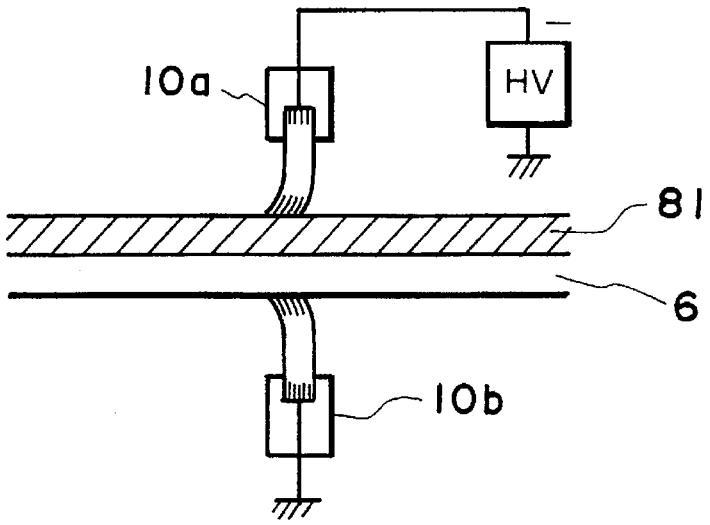
FIG. 9 shows an attraction charging means according to a further embodiment.

In this embodiment, the structure of the charging means for the attraction may be as shown in FIGS. 6–9, in place of the structure shown in FIG. 5. In place of the attraction roller 10*b*, an attraction charging brush 10*b* similarly to the attraction charging brush 10*a* is usable (FIGS. 6, 7 and 9). If desired, to the members 10*a* and 10*b*, a high voltage source hV having a predetermined polarity is connected, or they may be grounded.

Thus, in this embodiment, the amount of charge-up of the transfer sheet 81 can be reduced, and in addition, an attraction charging brush 4, that is, a contact element such as a conductive brush in this embodiment may be used for the transfer operation, by which the stabilized image transfer process which has been difficult in the conventional corona transfer operation, can be accomplished.

The conditions of the full-color copying machine used in this embodiment were as follows. The photosensitive drum 1 had an OPC photosensitive member of a diameter of 80 mm, and the transfer drum 8 had a diameter of 160 mm, and the process speed was 160 mm/sec.

The used developer contained the toner which had the negative electric charge, and the reversal development is performed.

Embodiment 2

In the first embodiment, for the purpose of the attraction of the recording material 6 to the transfer drum 8, the contact element 10 (conductive brush), that is, the charging brush for the attraction, was used. However, the same advantageous effects can be provided even if a corona discharger is used.

Figure 10:
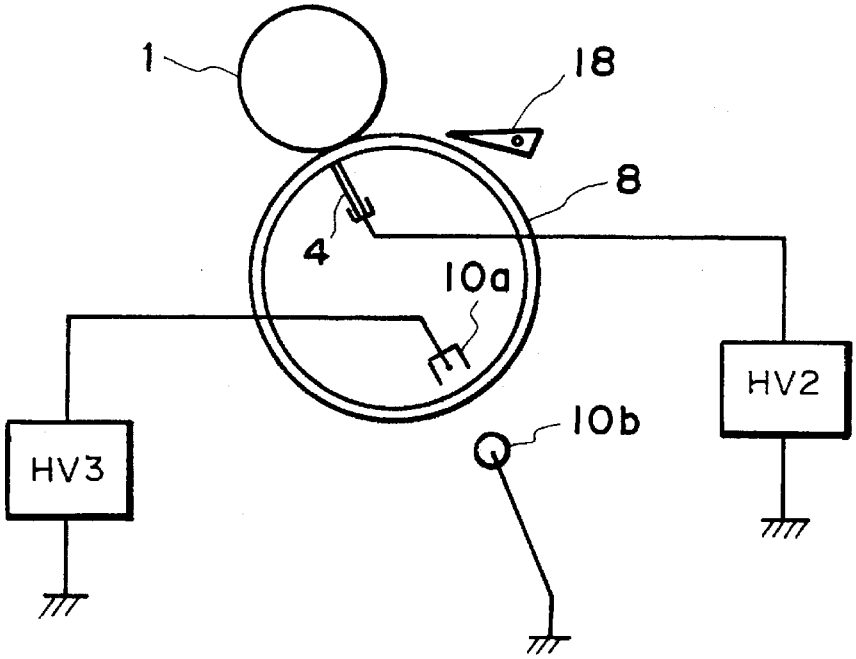
FIG. 10 is an illustration of an image forming apparatus according to a second embodiment of the present invention.

FIG. 10 is a schematic illustration of an image forming apparatus according to a second embodiment of the present invention.

According to this embodiment, a DC bias voltage source HV3 is connected to an attraction charger 10*a*. This voltage source HV3 is operated in synchronism with the feeding of the recording material 6. The voltage source HV3 may be of constant current or constant voltage type, but a constant current controlled transformer is used in this embodiment. The distance between the charging wire of the attraction charger 10*a* and the transfer sheet 81 is approx. 10 mm, and a width of the opening of the shield plate was approx. 20 mm. Furthermore, the output was 300 μA.

Figure 11A:
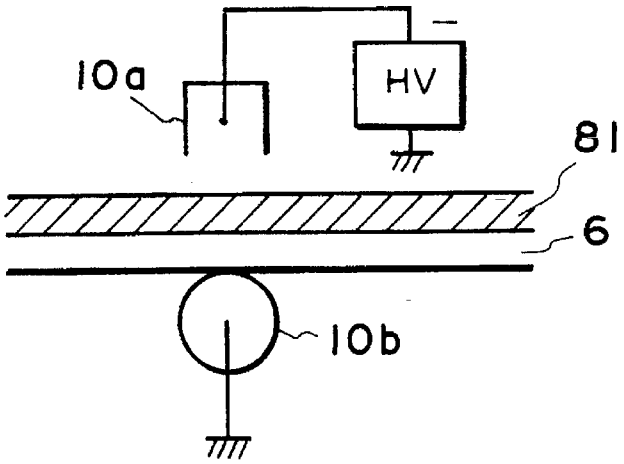
FIGS. 11A, 11B and 11C show an attraction charging means according to another embodiment.
Figure 11B:
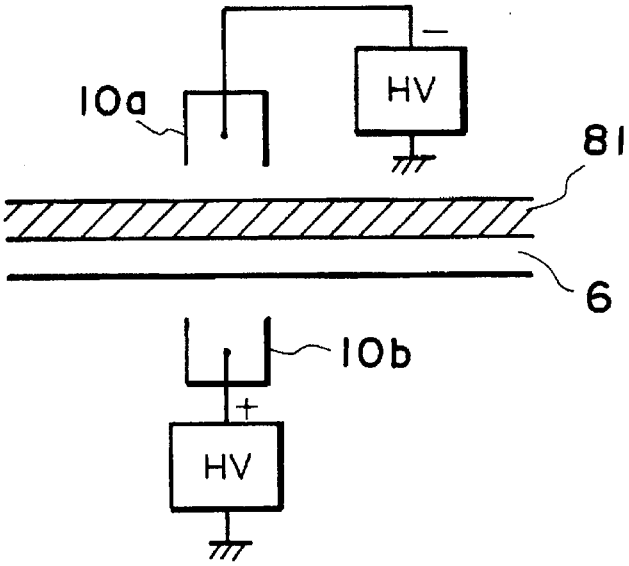
Figure 11C:
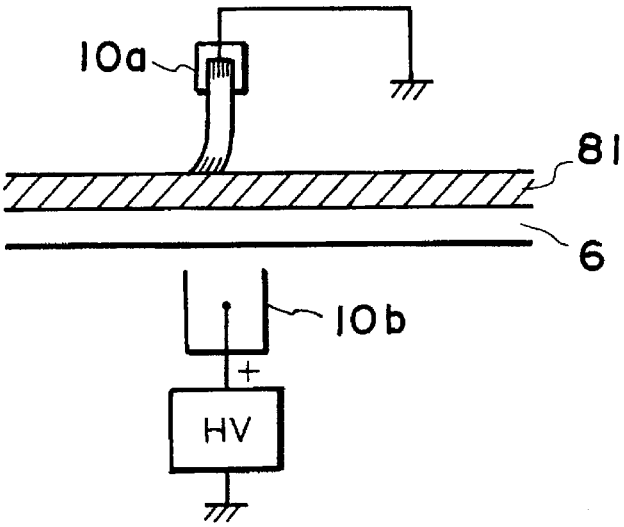

In place of the structure shown in FIG. 11A, the structure of the attraction charging means using the corona discharger may be as shown in FIGS. 11B and 11C.

Namely, in place of the attraction roller 10*b*, a corona discharger is used (FIG. 11B), and in place of the attraction charger 10*a*, an attraction charging brush is usable. In place of the attraction roller 10*b*, a corona discharger is usable (FIG. 11C).

Embodiment 3

For the purpose of the transfer to the recording material 6 of the transfer image, the contact element (conductive brush), that is, a transfer charging brush 4*a* was used in the first embodiment. However, the same advantageous effect can be provided even when a feedback type corona discharger capable Of controlling the electric current toward the transfer sheet 81 is used.

Figure 12:
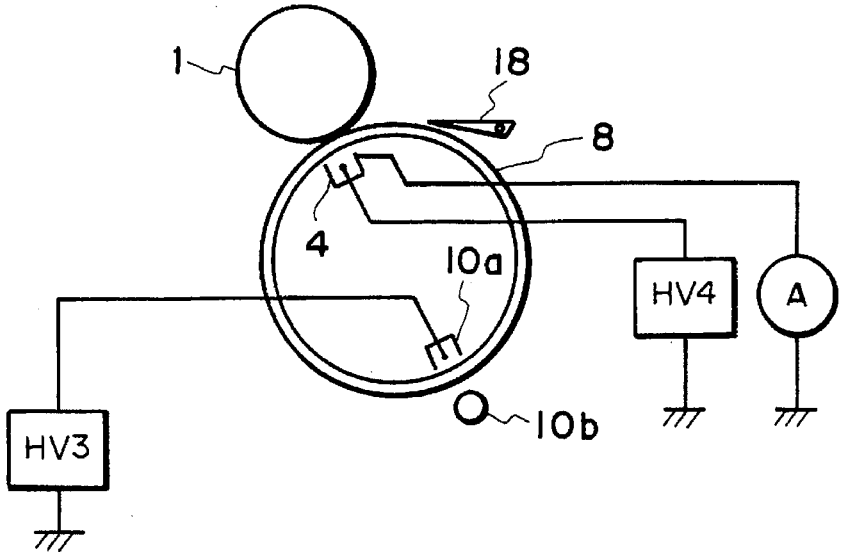
FIG. 12 is a schematic illustration showing an image forming apparatus according to a third embodiment of the present invention.

FIG. 12 is a schematic illustration of an image forming apparatus according to a third embodiment of the present invention.

Figure 13:
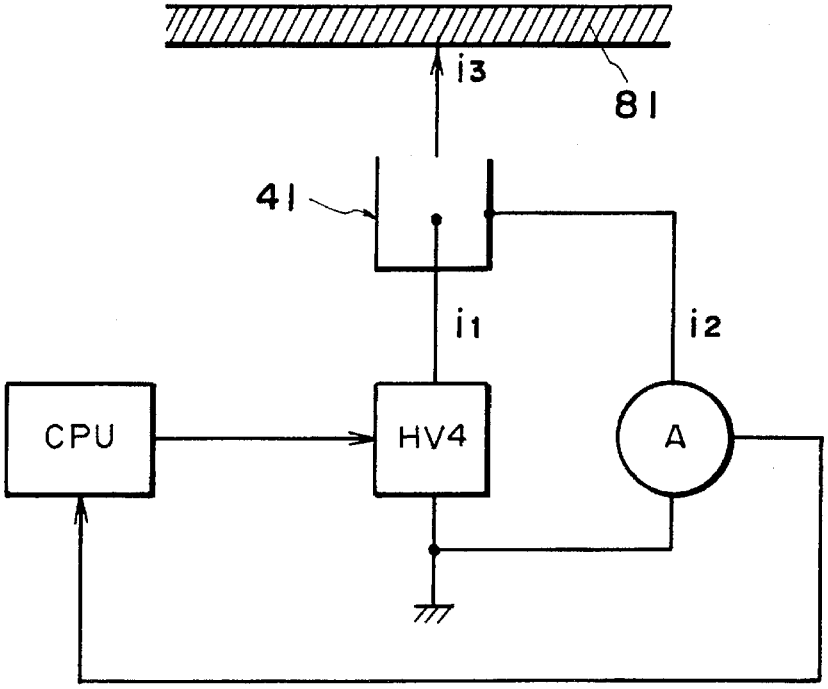
FIG. 13 illustrates a controlling method for a current to a shield plate of a transfer corona discharger.

A DC bias voltage source HV4 is connected to a transfer corona discharger 41, and it produces output in synchronism with the transfer timing. Moreover, an ammeter is connected to the shield plate to permit monitoring of a current toward the shield plate of the transfer corona discharger 41. The details are shown in FIG. 13.

In this embodiment, the current i3 flowing into the transfer sheet 81 is controlled to be constant by monitoring the electric current i2 flowing into the shield plate. Namely, i3=i1−i2 is used. While measuring the current i2, the current i1 is used by a CPU so that the current i3 is constant.

In this embodiment, the voltage source HV4 is in the form of a constant current controlled transformer.

The distance between the charging wire and the transfer sheet 81 was 8 mm, and the width of the opening of the shield plate was approx. 20 mm.

Furthermore, the output range of the voltage source HV4 was 0–9 KV, and 0–500 μA.

Table 1 shows an example of outputs for attraction and transfer capable of providing proper image. From Table 1, it will be understood that in the superpose transfer, the current i3 toward the transfer sheet is an important factor for the transfer (transfer efficiency). Particularly when a corona discharger is used, it is preferable to sequentially increase the total current i1 in order to maintain the constant current i3 toward the transfer sheet.

TABLE 1

| Current | Attraction | Transfer 1 | Transfer 2 | Transfer 3 | Transfer 4 |
|---|---|---|---|---|---|
| Total current il | −300 | 200 | 250 | 300 | 350 |
| To shield i2 | — | 185 | 235 | 285 | 335 |
| To transfer sheet i3 | — | 15 | 15 | 15 | 15 |

Figure 24:
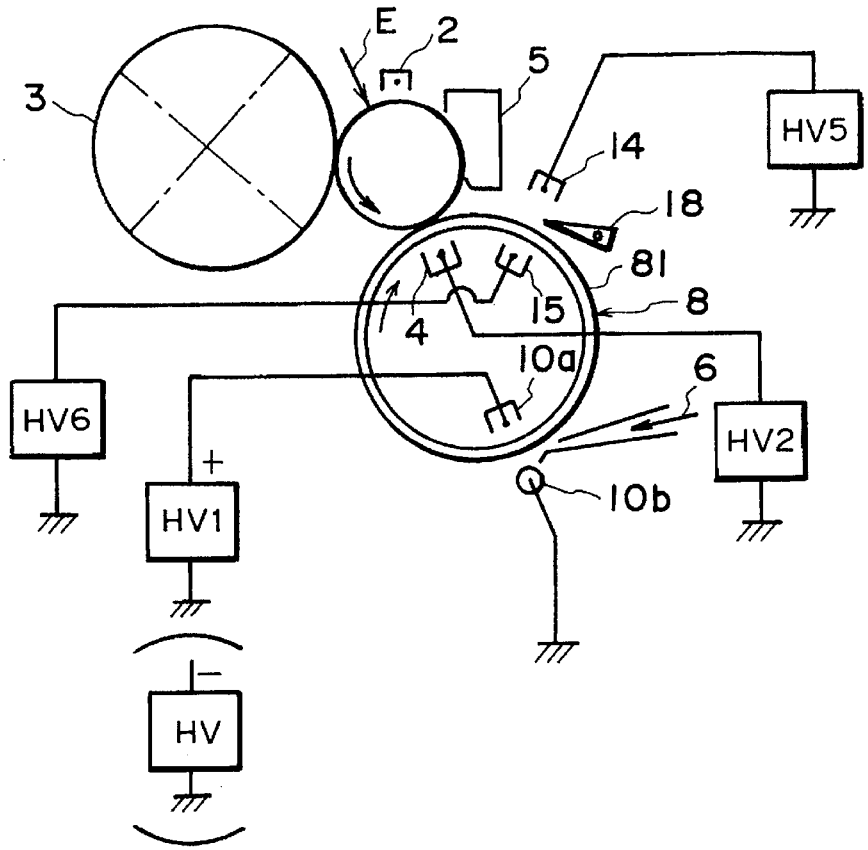
FIG. 24 is an illustration of a conventional image forming apparatus.
Figure 25:
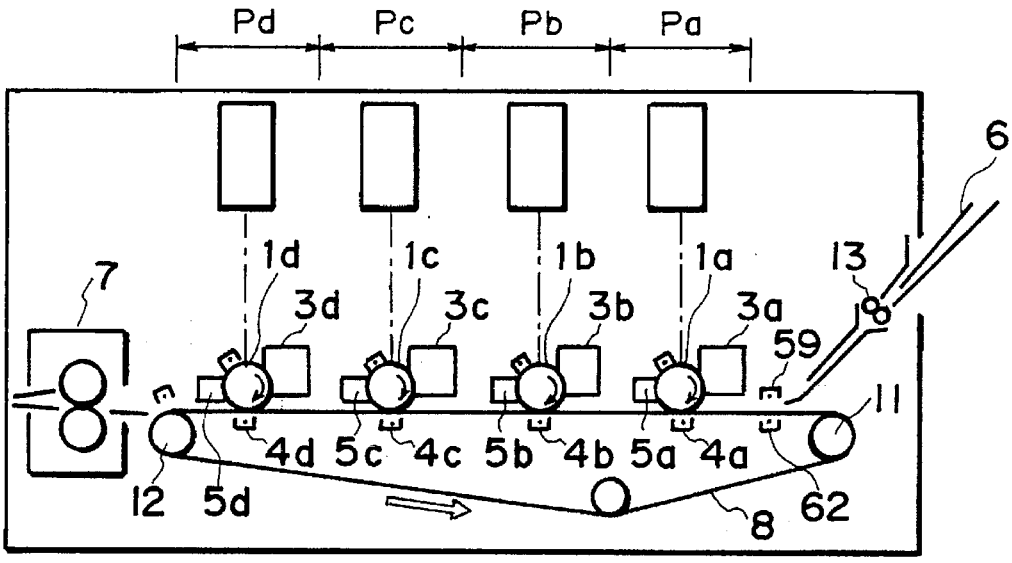
FIG. 25 is an illustration of a conventional image forming apparatus.
Figure 26:
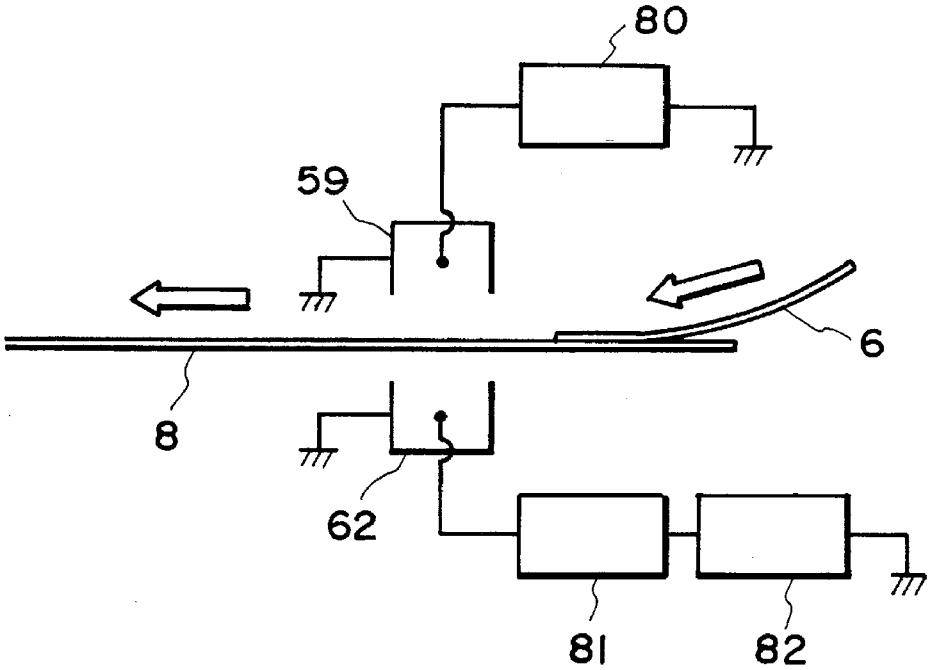
FIG. 26 is an enlarged view of an attraction charging means for the device of FIG. 25.
Figure 27:
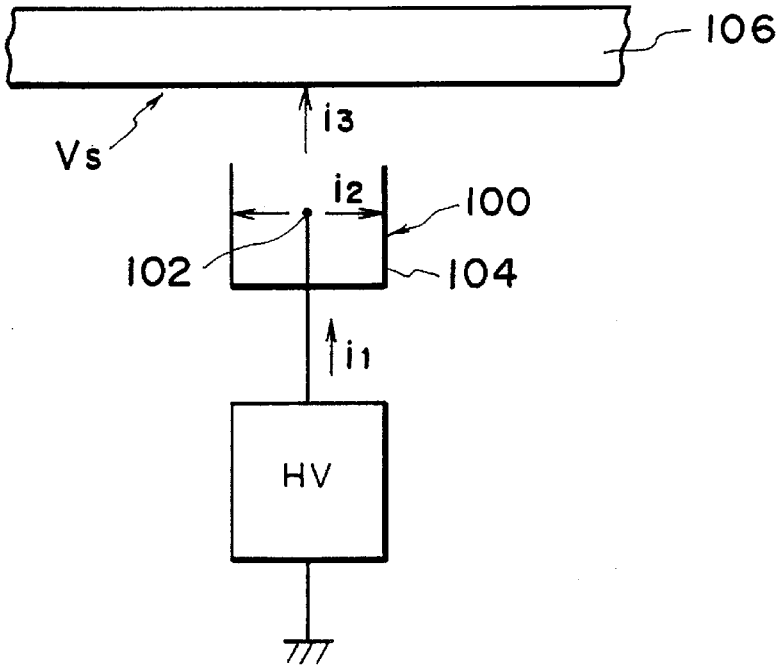
FIG. 27 illustrates an operation of the corona discharger.

The advantageous effect of the first to third embodiments include the following. The inside discharger 15 and the outside discharger 14 for discharging the transfer sheet used in the conventional device shown in FIG. 24, is not needed. The proper superpose transfer can be performed, without the transfer sheet 81 being charged up, even during the continuous copying operation, by using the bias of the opposite polarity (the same polarity as the toner) from the transfer charge polarity, upon the attraction charging operation. Namely, the stabilization and the cost reduction are realized by simplifying the transfer structure. In addition, by the use of a transfer system in which the transfer current toward the transfer sheet is controlled, that is, a contact transfer using a conductive brush or a transfer using a feedback control type corona discharger, the superpose transfer operation can be stabilized. In addition, the transfer means is preferably a transfer brush because as compared with the corona discharger, the ozone production is very small, and the structure of the electric circuit is simplified. In the foregoing embodiments, the high voltage source has been in the form of a DC source. However, it may be in the form of a DC biased AC voltage source, for the charging.

Embodiment 4

Figure 14:
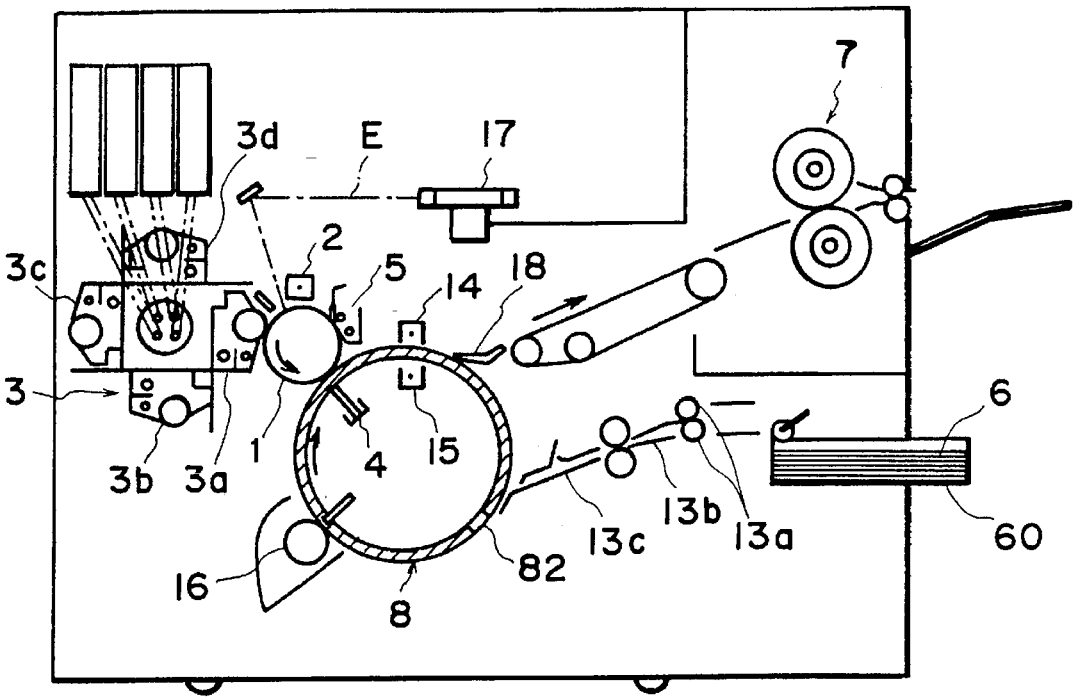
FIG. 14 is an illustration showing an image forming apparatus according to a fourth embodiment of the present invention.

FIG. 14 shows an image forming apparatus according to a fourth embodiment of the present invention, wherein the present invention is applied to a digital full-color electrophotographic copying machine. This copying machine is substantially the same as the apparatus according to the first embodiment (FIG. 1) in the operation. However, the method of carrying the recording material 6 on the transfer drum 8 is different. Therefore, the operation will be described particularly on this point. The recording material 6 fed from the recording material cassette 60 through by the feeding roller 13*a* along the feeding guides 13*b* and 13*c*, is pushed out in a direction along the transfer drum 8.

Figure 15:
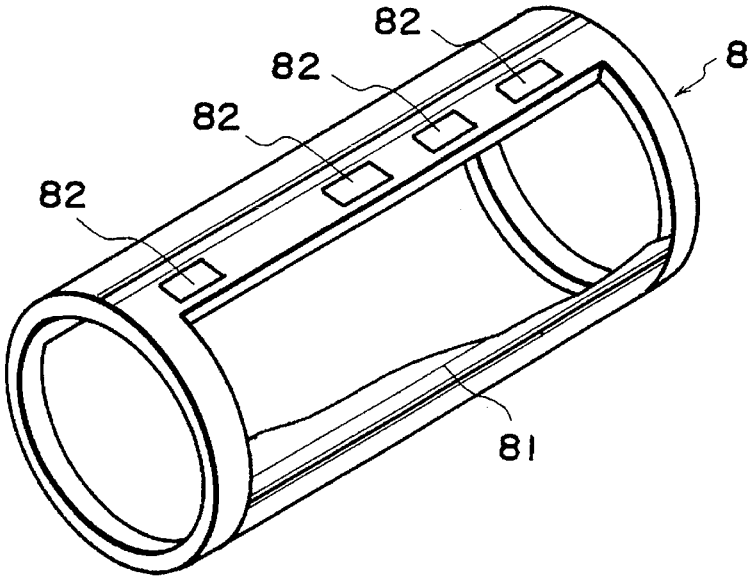
FIG. 15 is a perspective view of a transfer drum to be used in the device of FIG. 14.

As shown in FIG. 15, the transfer drum 8 is provided with a gripper 82 for carrying the recording material 6 the leading end portion of the recording material 6 fed to the transfer drum 8 is gripped by a gripper 82 driven by the driving source (not shown). As a result, the recording material 6 is carried on the transfer drum 8 and is conveyed to the transfer position.

Moreover, after completion of the superposed transfer for four colors by the above-described series of operations, the recording material 6 carried on the transfer drum 8 is separated from the transfer drum by the separation claw 18 with the outside separation charger 14 and inside separation charger 15 operated. It is conveyed to the fixing device 7 by a conveyer belt, and the series of full-color print operation is completed, and the full-color print image is provided.

Figure 16:
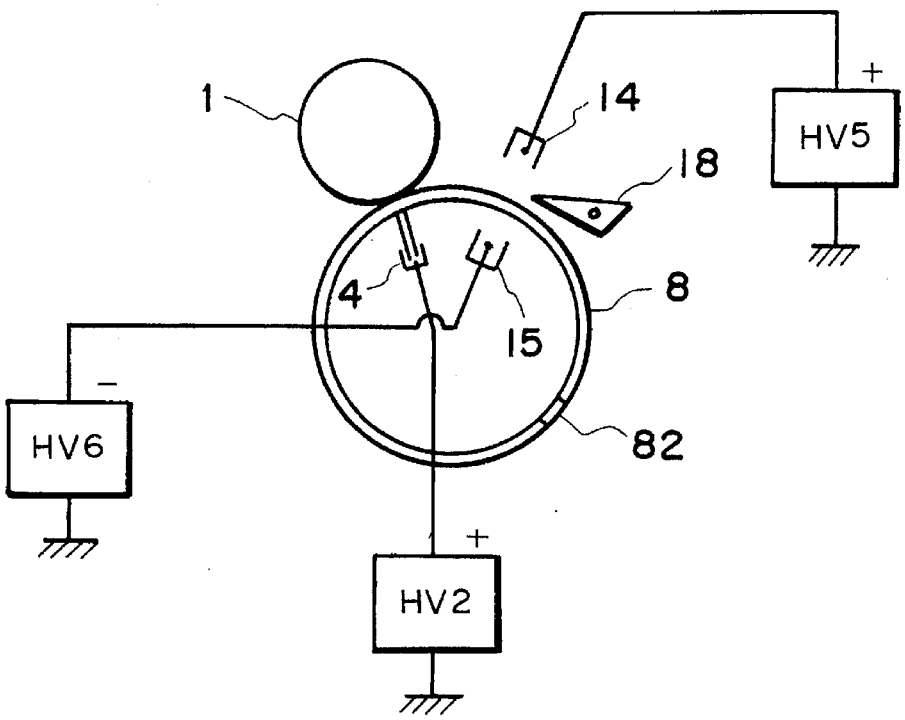
FIG. 16 is a schematic illustration of a transfer drum, a photosensitive drum and a high voltage source associated therewith, of the device of FIG. 14.

FIG. 16 shows the transfer drum 8, the photosensitive drum 1 and the associated high voltage source HV for the copying machine shown in FIG. 14.

As described hereinbefore, when the recording material 6 is fed to the transfer drum 8, the recording material 6 is gripped by the gripper 82, and is rotated to the transfer position. In synchronism with the recording material 6 coming to the transfer position, the DC bias voltage is applied from the high voltage source HV2 to the transfer charging brush 4. The voltage source HV2 is in the form of a constant current transformer in this embodiment. A constant current is applied to the brush 4, and the output value of the voltage source HV2 is set to approx. 15 μA.

When the second to fourth color transfer operations are carried out under the same conditions, the high voltage sources HV5 and HV6 are operated so that the inside separation charger 15 and the outside separation charger 16 start the discharging operation. The voltage source HV6 provides the polarity opposite to that for the image transfer, that is, the same polarity as the toner, and it is the constant current transformer in this embodiment, the current is approximately set to −300 μA. Immediately thereafter, the recording material is separated from the transfer drum 8 by the claws 18.

In this embodiment, in place of the transfer charging brush 4, a feedback control type corona discharger shown in FIG. 13 is usable.

Figure 17:
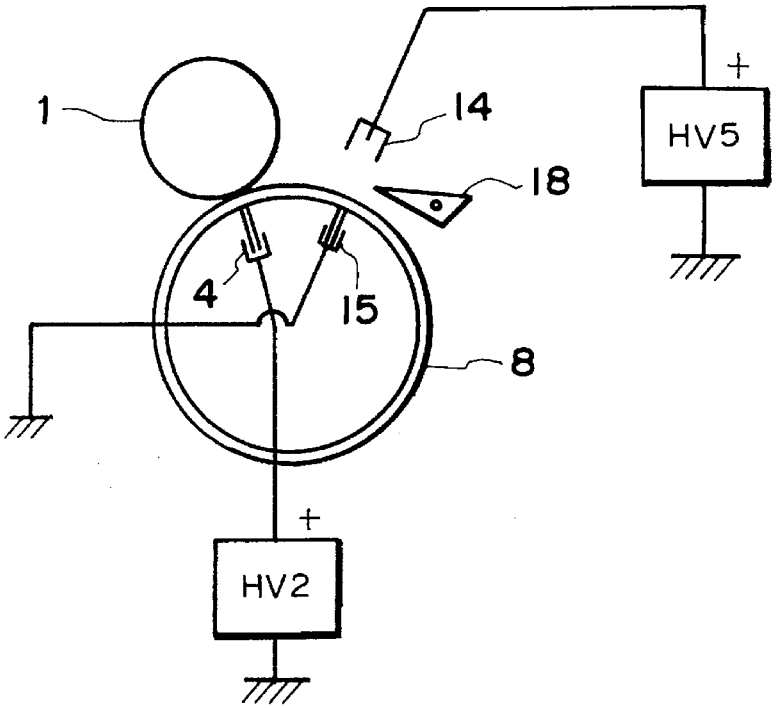
FIG. 17 is a schematic illustration of another embodiment of a transfer drum, a photosensitive drum and a high voltage source associated therewith, in the device of FIG. 14.

Immediately before the separation position for the recording material, a pair of corona dischargers 14 and 15 supplied with an AC voltage source are used for the electric discharge, but as shown in FIG. 17, in place of the inside separation charger 15, a grounded contact element (conductive brush) 15 is usable to inject the negative charge to the backside of the transfer sheet 81.

As will be understood in the above-described description, also in this embodiment, the repetition of the cycle of the electric charge model as has been described in association with FIG. 3 embodiment, is carried out. By doing so, the same advantageous effects can be provided as in the first embodiment. As a result, in the continuous copying operation, the charge up of the transfer sheet can be avoided with the result of proper superpose transfer in this embodiment.

Embodiment 5

Figure 18:
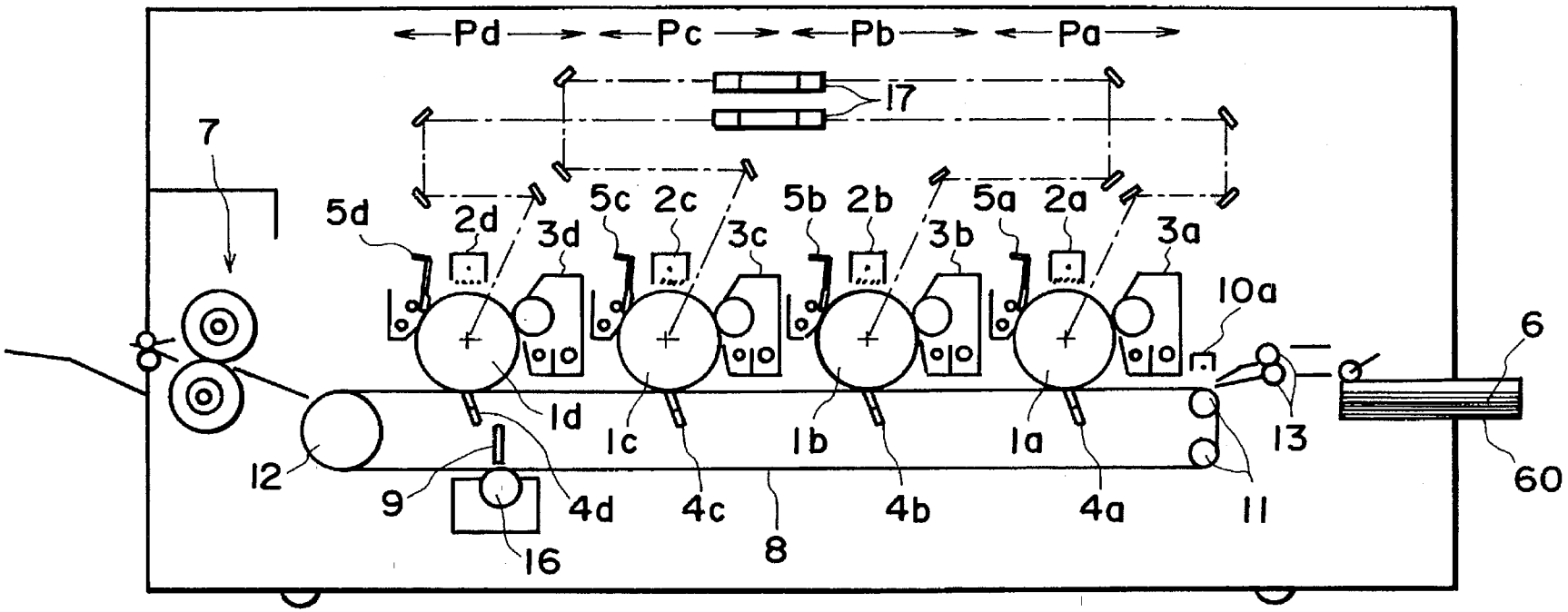
FIG. 18 is an illustration showing an image forming apparatus according to a fifth embodiment of the present invention.

FIG. 18 is an illustration of an image forming apparatus according to a fifth embodiment of the present invention. It is in the form of a digital full-color electrophotographic copying machine provided with four photosensitive drums similar to the full-color electrophotographic copying machine shown in FIG. 24 operation of this copying machine will be described.

As shown in FIG. 18, there are provided a first, second, third and fourth image forming means Pa, Pb, Pc and Pd in the main assembly of the copying machine. They functions to form different color images through the electrostatic image formation, image developing and image transfer processes.

The image forming means Pa, Pb, Pc and Pd are respectively provided with image bearing members 1, namely, photosensitive drums 1*a*, 1*b*, 1*c* and 1*d*. The toner images formed on the photosensitive drums 1*a*, 1*b*, 1*c* and 1*d* by the image forming means Pa, Pb, Pc and Pd, respectively, are transferred onto a recording material 6 carried on the recording material carrying member 8 adjacent the image forming means.

The recording material carrying member 8 is in the form of a transfer belt, and it is stretched between a driving roller 12 and a supporting roller 11. After the completion of the image transfer, the image on this recording material 6 is heated and pressed by a fixing device 7 into a fixed image.

The description will be made in more detail. In the toner image formation on the photosensitive drums 1*a*, 1*b*, 1*c* and 1*d*, the photosensitive drums 1*a*, 1*b*, 1*c* and 1*d* are charged uniformly by the chargers 2*a*, 2*b*, 2*c* and 2*d* disposed at the respective outside of the photosensitive drums. The photosensitive drums are scanned by image signals through a laser beam exposure device 17, by which latent images are formed. The latent images are developed by developing devices 3*a*, 3*b*, 3*c* and 3*d* which contain different color developers, so that the toner images are formed on the photosensitive drums 1*a*, 1*b*, 1*c* and 1*d*.

On the other hand, the recording material 6 is fed to a transfer belt 8 through a registration roller 13 from the recording material cassette 60.

Here, the transfer belt 8 is made of a dielectric resin film such as a polyethylene terephthalate resin film sheet (PET sheet), a polyvinylidene fluoride resin film sheet or a polyurethane resin film sheet. It is overlaid and joined at the opposite ends into an endless belt, or a seamless belt is usable. In the case of the seamless belt, it is difficult to manufacture a belt having uniform property, and in addition, it is not suitable for mass-production because of the instable peripheral length, manufacturing time and cost. On the other hand, in the case of the belt having a seam, if the image formation is effected on the seam position, the change of the property such as the irregularity of the seam portion, and the resistance value, can not be avoided, and therefore, the image will be disturbed by the seam. Therefore, in order to provide the high quality of the image, an unshown means for detecting the seam position is used so that the image forming operation is not effected on the seam.

When the recording material 6 is conveyed from the registration roller 13 to the transfer belt 8, the attraction charger 10*a* operates, and the recording material is attracted onto the transfer belt 8.

The toner image on the photosensitive drum 1*a* is transferred onto the recording material 6 under the action of the transfer charging brush 4*a*. The recording material 6 is conveyed to the second, the third and the fourth image forming means Pb, Pc and Pd, and the toner images are superposedly transferred from the photosensitive drums 1*b*, 1*c* and 1*d*.

The recording material 6 on which the image formation has been carried out by the fourth image forming means Pd, is released from the transfer belt 8, and is conveyed to the fixing station 7.

After the transfer, the developers remaining on the photosensitive drums 1*a*, 1*b*, 1*c* and 1*d* are removed by the cleaning means 5*a*, 5*b*, 5*c* and 5*d*, and are prepared for the next latent image formation. The developer remaining on the transfer belt 8 is discharged by a discharging belt 9, so that the electrostatic attraction force is removed, and thereafter, the toners are scraped off by a rotating fur brush 16.

Figure 19:
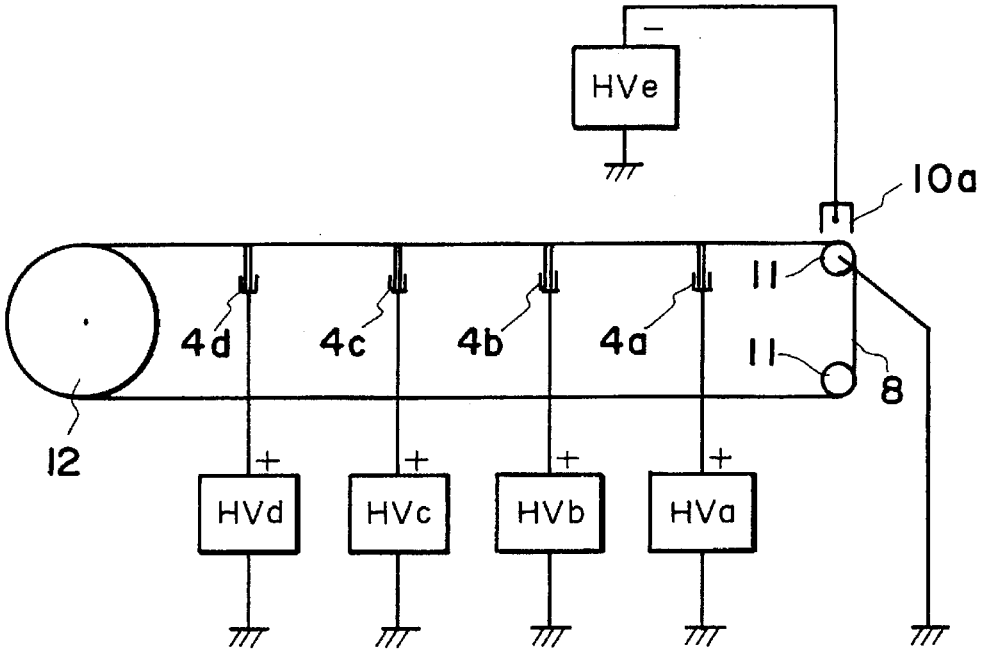
FIG. 19 is a schematic illustration of a transfer drum, a photosensitive drum and a high voltage source associated therewith or the like in the device of FIG. 18.

FIG. 19 is a schematic illustration of the transfer belt 8, the high voltage source HV associated therewith or the like, of the copying machine of FIG. 18.

When the recording material 6 is fed to the transfer belt 8, the DC bias voltage is applied from the high voltage source HVe to the corona discharger 10*a* for the attraction charge. In this case, since the DC bias is applied to the outside circumferential surface of the transfer belt 8, it is the positive bias which is the same polarity as the transfer charge. The output of the corona discharger 10*a* is set to 3–5 KV in this embodiment. As a result, from the grounded belt supporting roller 11 which functions as an opposite electrode, negative polarity (opposite from that of the transfer charge) is induced, so that the recording material 6 is electrostatically attracted on the transfer belt 8.

Subsequently, the first color M (magenta) toner is transferred, but at this time, the DC bias voltage is applied from the high voltage source HVa to the transfer charging brush 4*a*. The voltage source HVa is in the form of a constant current transformer, and the output thereof is approximately 10 μA, in this embodiment.

Similarly, the second to fourth image transfers operations are completed, and then, the recording material 6 is separated from the transfer belt 8. The electric charge model at the backside of the transfer belt 8 and at the front side of the recording material 6 in this embodiment, is the same as shown in FIG. 3. However, the change of the surface potential of the backside of the transfer belt 8 was measured by a different method.

Figure 20:
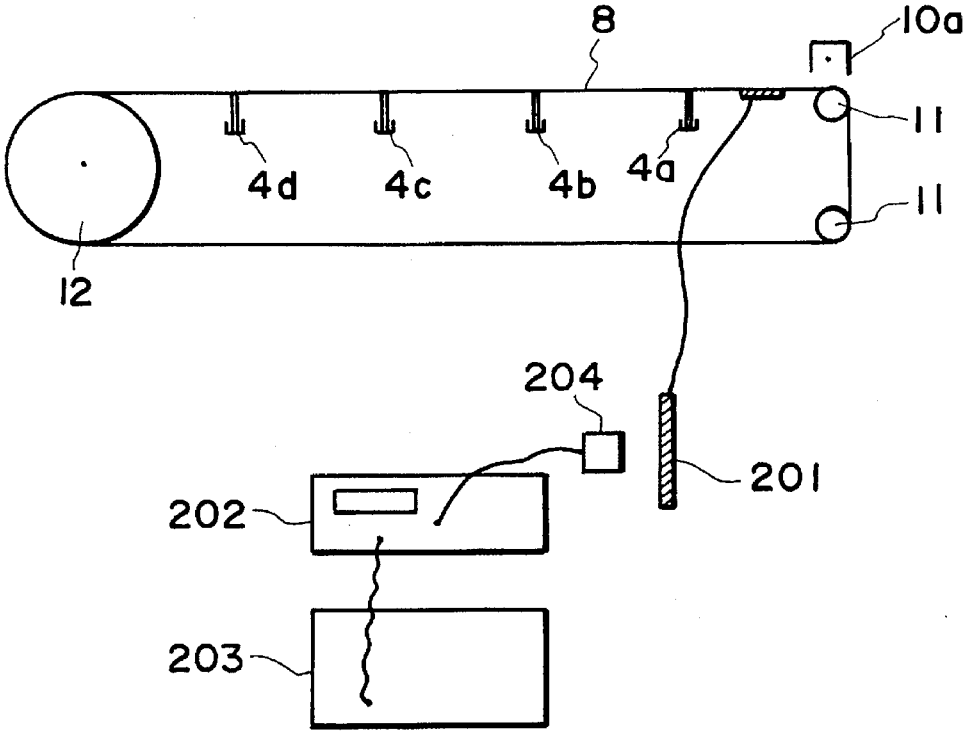
FIG. 20 is a schematic illustration of a measuring device for measuring change of the surface potential of the backside of a transfer belt by the device of FIG. 18.

FIG. 20 is a schematic illustration of the measuring device. In this method, a part of the backside of the transfer belt 8 is evaporated with aluminum, and a monitoring aluminum plate 201 is prepared which is connected by a metal wire to provide the same electric potential as that portion. On the other hand, a surface electrometer 202 and a recorder 203 for recording the output from this surface electrometer 202, is used.

Figure 21:
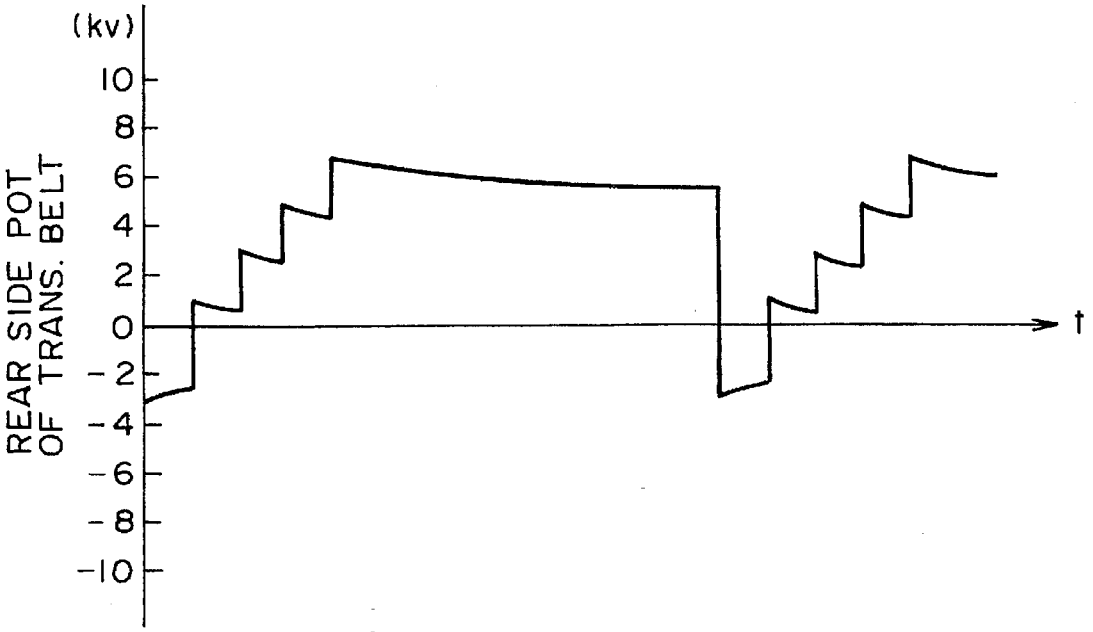
FIG. 21 shows a change of the surface potential of the backside of a transfer belt.

Here, a probe 204 of the surface electrometer 202 is made to approach the aluminum plate 201 for the motor, and the potential is measured. The results of the measurements in the copying operation are shown in FIG. 21.

As will be understood from the results of measurement, the electric potential sequentially increases with progress of the transferring operation, although the potential is negative due to the attraction charge. Then, the transfer belt 8 rotates and is subjected to the attraction charging operation. The cyclic operation is repeated. The potential change is dull because the electric charge on the surface of the recording material 6 and the backside of the transfer belt 8 leak spontaneously.

Thus, even in the transfer belt type copying machine, by charging the backside of the transfer belt 8 to the polarity opposite from the transfer charging in the attraction charging, the proper superposing transfer operation is possible without charging-up of the transfer belt 8 even during the continuous copying mode operation. In addition, if a contact element (conductive brush in this embodiment) for the transfer charging, the proper transfer operation is possible irrespective of the potential of the transfer belt 8.

Embodiment 6

Figure 22:
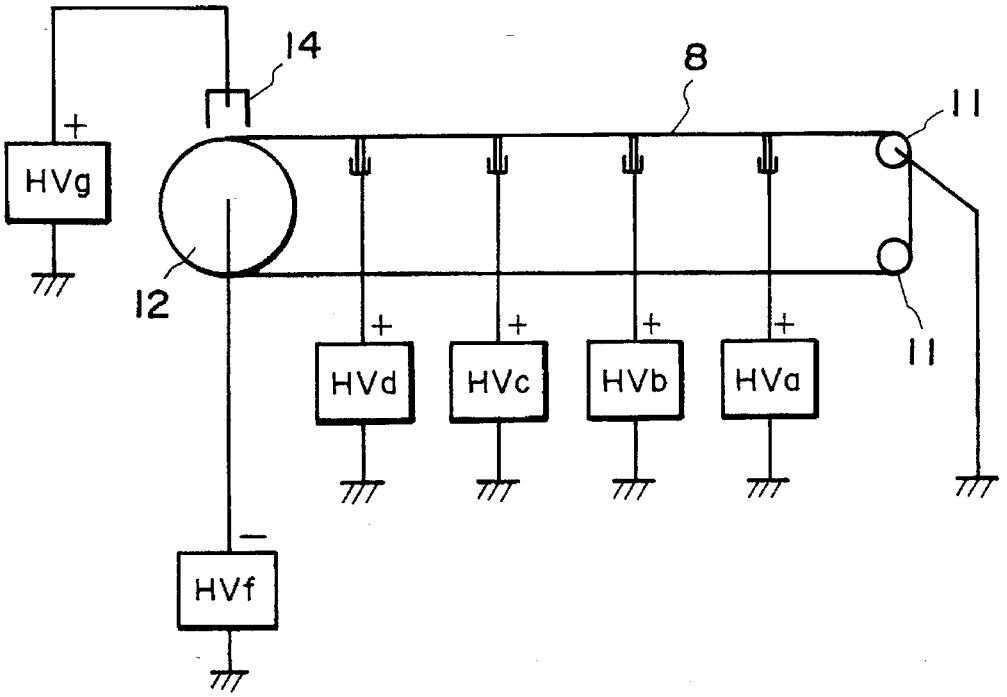
FIG. 22 is an illustration of an image forming apparatus according to a sixth embodiment of the present invention.

FIG. 22 shows a sixth embodiment of the present invention. This embodiment is similar to the digital full color electrophotographic copying machine which has been described with respect to the fifth embodiment of the present invention. It is provided with four photosensitive drums. However, the high voltage generating means associated with the transfer belt 8 is different. The same advantageous effects as in the fifth embodiment can be provided.

The operation will be described. The recording material 6 on which the superposing transfer operations for the four colors by the high voltage source HVa–HVd, is electrically discharged by a discharger 14 connected with a high voltage source HVg. In this embodiment, the high voltage source HVg is a DC transformer, and the discharger 14 produces corona discharge by the output of the DC transformer. Simultaneously, a high voltage source HVf connected with the driving roller 12 for the transfer belt 8 is operated. The voltage source HVg is a constant current DC transformer. In this embodiment, the current thereof is set to 200 μA approximately. The high voltage source HVf is a constant voltage transformer, and the voltage is set to −3 KV approximately.

As a result, the positive charge on the backside of the transfer belt 8 accumulated by the transfer charging, is removed, and then, it is electrically charged to the negative polarity.

Figure 23:
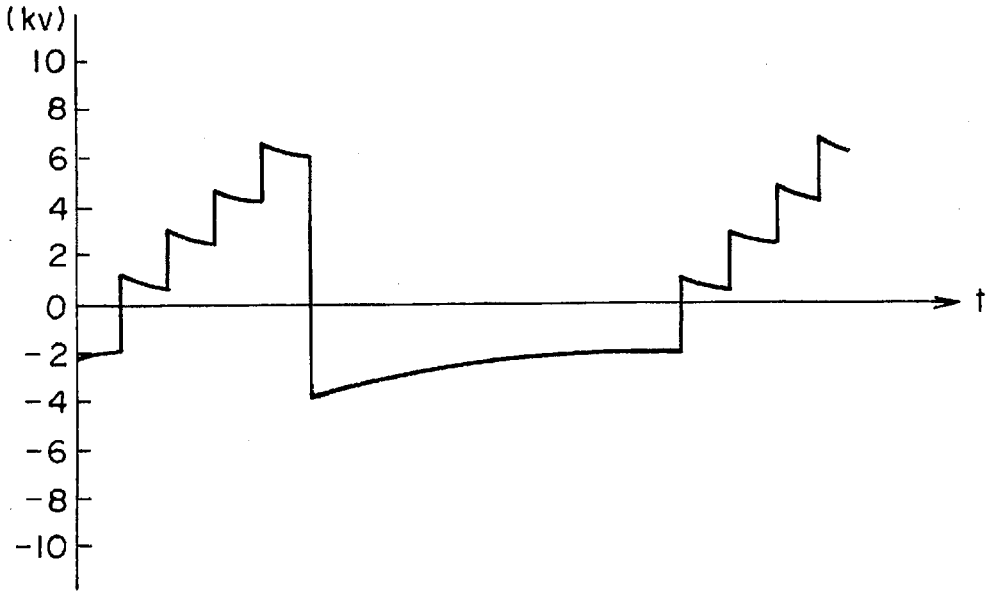
FIG. 23 shows a change of a surface potential of the backside of a transfer belt of the device of FIG. 22.

The change of the surface potential at this time is measured through the same measuring method as described hereinbefore, and the results are shown in FIG. 23.

In the foregoing embodiments, the potential of the backside of the recording material carrying member may be made to the polarity opposite to that of the transfer current prior to each of the transfer operation in the superposing transfer process.

The transfer brush described hereinbefore is supplied with a voltage from a high voltage source, but another example in which the transfer brush is grounded, and an example in which it is grounded through an impedance element, will be described.

Embodiment 7

Figure 28:
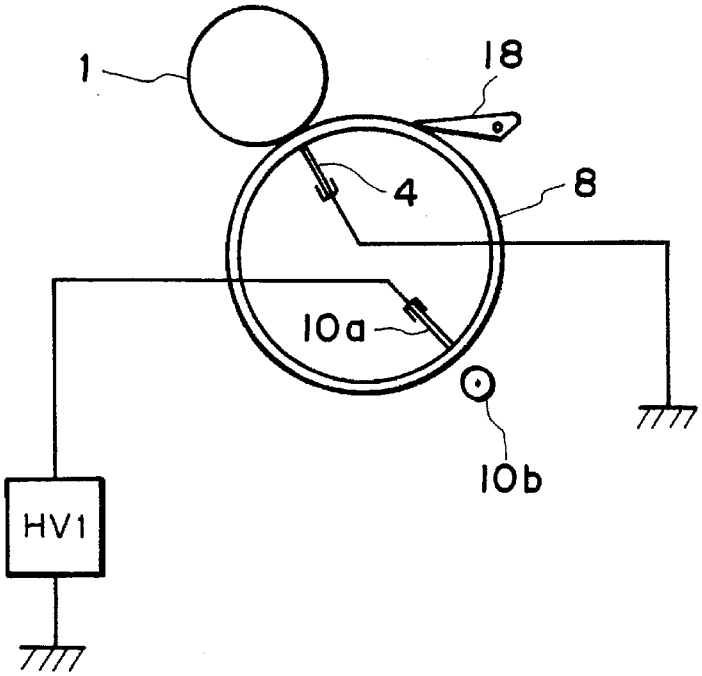
FIG. 28 shows a device according to a seventh embodiment, of a transfer drum, photosensitive drum, and a high voltage source associated therewith in the device of FIG. 1.
Figure 29:
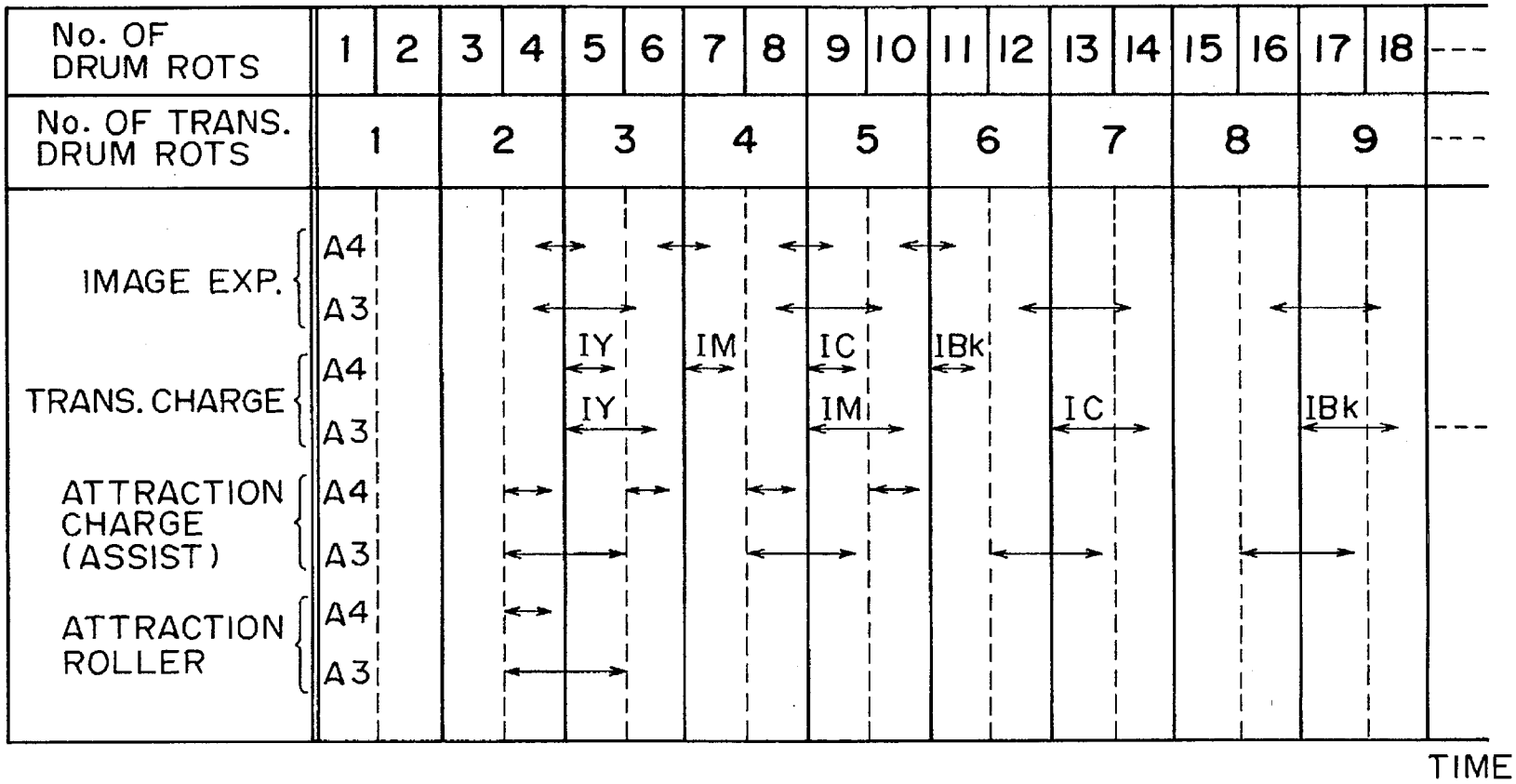
FIG. 29 is a timing chart of a copying machine of the seventh embodiment of the present invention.

FIG. 28 is a schematic illustration of a copying machine in which the brush 4 is grounded without use of the high voltage source HV2. FIG. 29 is an operational timing chart of the copying machine.

Figure 30A:
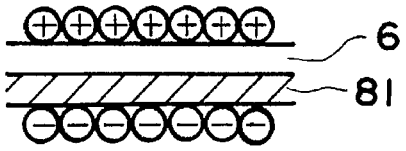
FIGS. 30A, 30B, 30C, 30D, 30E, 30F, 30G and 30H illustrate electric charge model of the recording material carrying member and the recording material in a copying machine of the superpose transfer type, in accordance with the copy process.

The recording material is fed so as to be along with the transfer drum 8, the DC bias voltage is applied from the high voltage source HV1 to the attracting charging brush 10*a*. The high voltage source HV1 is a constant current transformer, and the output thereof is set to −50 μA. At this time, the attraction roller 10*b* is brought into contact to the transfer drum 8, and the recording material is pushed to the transfer sheet 81 which is a recording material carrying member wrapped around the transfer drum 8. On the surface of the recording material 6, positive charge which is opposite from that of the above-described bias, is induced. As a result, the recording material 6 is electrostatically attracted to the transfer drum 8. The electric charge model at this time is shown in FIG. 30A.

Subsequently, to the recording material carried on the transfer sheet 81, a first color Y (yellow) toner is transferred first. However, at this time, the electrically conductive transfer charging brush 4 is grounded, and therefore, the backside of the transfer sheet 81 is at substantially 0 potential. At this time, to the backside of the transfer sheet 81, the positive charge (opposite from that of the toner) is induced, and therefore, the toner is removed from the photosensitive drum 1 into the recording material 6. As a result, the negative charge on the backside of the transfer sheet 81 is reduced by this phenomenon. However, the potential is not completely 0, and the negative charge rich state still continues.

Figure 30B:
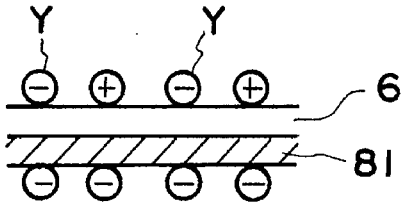

FIG. 30B shows the charge model after the toner transfer for the first color Y.

Then, prior to the second color transfer, the attraction charging brush 10*a* again operates, and the DC bias voltage is applied from the high voltage source HV1. However, at this time, since an unfixed toner is deposited on the recording material 6, the attraction roller 10*b* is not contacted to the transfer drum 8.

The charge of the attraction charging brush 10*a* at this time is not for attracting the recording material 6 onto the transfer sheet 81, and therefore, it is not appropriate to call it the attraction charge, so it is called auxiliary transfer charge.

Figure 30C:
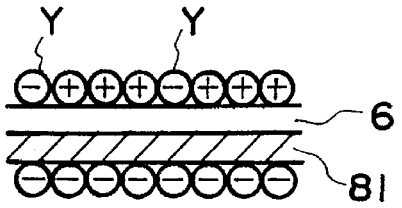

The charge model after the auxiliary transfer charging is shown in FIG. 30C. To the backside of the transfer sheet 81, the negative charge is injected. On the other hand, to the surface of the recording material 6, the corresponding positive charge is injected from the ambience, into the state of FIG. 30C.

Subsequently, the second color M (magenta) toner transfer is carried out. Also, at this time, the transfer charging brush 4 is electrically grounded, and therefore, the negative charge on the backside of the transfer sheet 81 is decreased toward the 0 potential. However, the negative charge still remains.

Figure 30D:
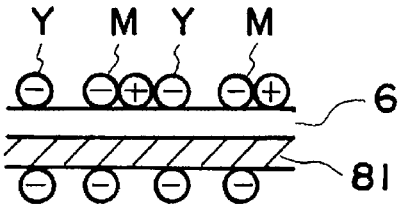
Figure 30E:
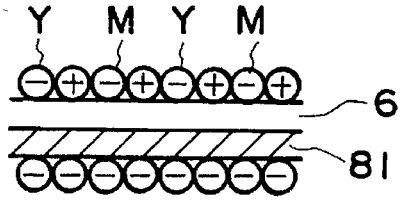
Figure 30F:
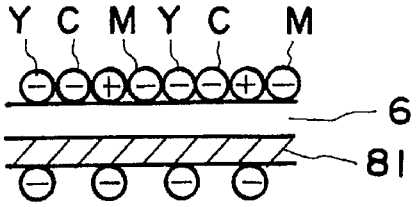
Figure 30G:
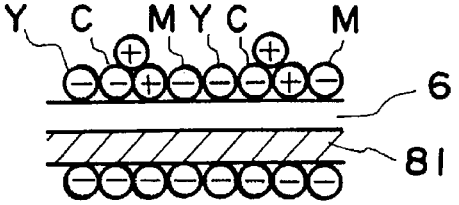
Figure 30H:
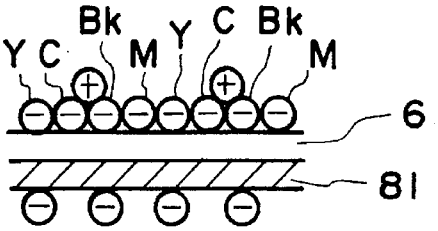

By the injection of the positive charge, the magenta M toner is transferred onto the recording material 6. The charge model is shown in FIG. 30D.

Similarly, the pre-transfer auxiliary charging for the third color C (cyan) toner, the toner transfer of the third color C (cyan) toner, pretransfer auxiliary charging for the fourth color Bk (black) toner, and the transfer of the fourth Bk (black) toner, are carried out. The electric charge models at this time, are shown in FIGS. 30E, 30F, 30G and 30H.

The recording material 6 having received the four color toner image is separated from the transfer drum 8 by the separation claws 18. At the time of the continuous copy, the next recording material 6 is supplied immediately. The operation is the same as described in the foregoing. Therefore, the cycle of the electric charge model is FIGS. 30A-30B-30C-30D-30E-30F-30G-30H-30A.

Figure 31:
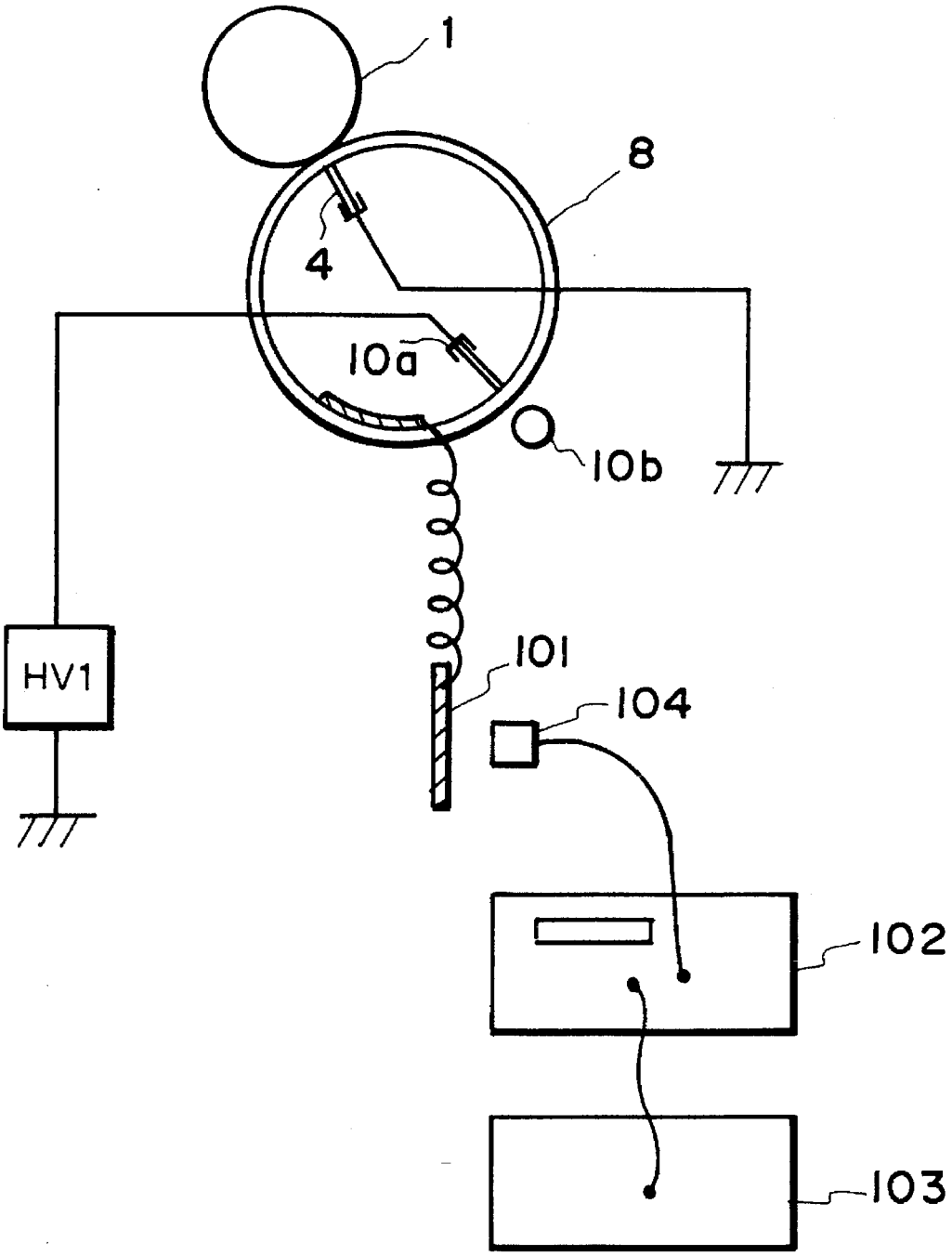
FIG. 31 is a schematic illustration of a measuring device for measuring a change of the surface potential of the backside of the transfer belt in the device of FIG. 1.

The inventors have measured the surface potential of the backside of the transfer sheet 81 by a measuring device shown in FIG. 31.

This measuring device will be described. First, an aluminum is evaporated to a part of the transfer sheet 81 of the transfer drum 8. A monitoring aluminum plate 101 is prepared connected therewith by a metal wire to provide the same potential. An electrometer 102 and a recorder 103 for recording output of the electrometer 102, are connected.

On the other hand, a measuring probe 104 of the electrometer 102 is brought close to the monitoring aluminum plate 101, by which the potential of the backside of the transfer sheet 81 is indirectly measured.

Figure 32:
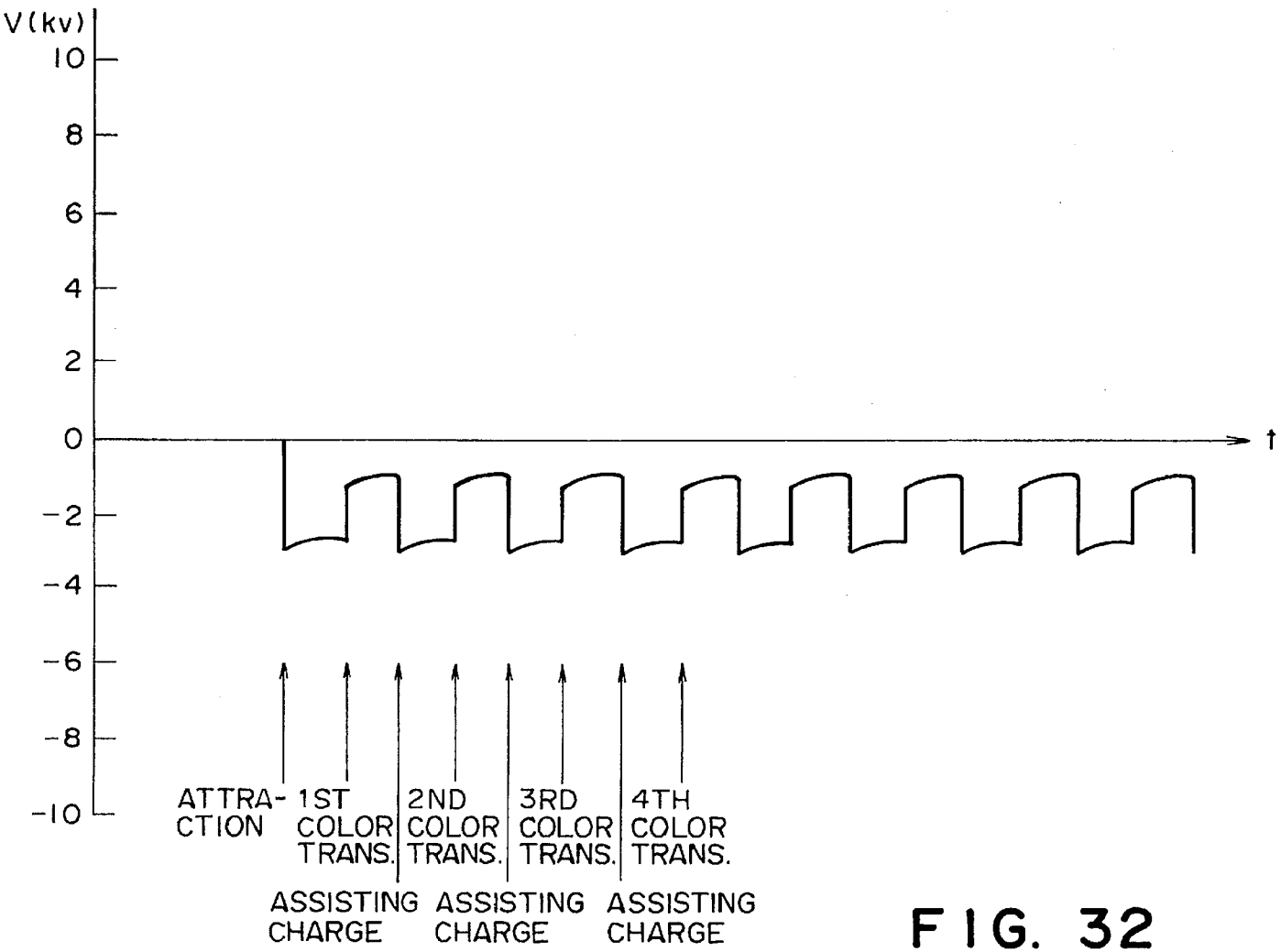
FIG. 32 shows results of measurement of a surface potential of the backside of the transfer sheet in a position of rotation direction downstream of the attracting position.

The results of measurements of the surface potential of the backside of the transfer sheet 81 during the copying operation, are shown in FIG. 32.

After the attraction and auxiliary charging operations, the transfer sheet 81 is charged approx. to −3.0 KV, and after the transfer, the potential decreases down to approx. −1.0 KV, as will be understood. The reason why the potential change is dull is that the electric charge on the backside of the transfer sheet 81 spontaneously leaks.

As will be understood also from this results of measurement, by charging to the same polarity as the toner in the attraction step and by effecting the toner transfer by the induced current without application of the bias voltage (current), the transfer sheet 81 is usable with very small potential, and therefore, the charging-up thereof can be avoided even during the continuous copying mode operation.

In this embodiment, the attraction charging means may be of the structure shown in FIGS. 6–9, in place of the structure shown in FIG. 5. In this embodiment, the transfer efficiency is determined by the potential of the transfer sheet coming to the transfer position. The potential of the transfer sheet 81 is determined by the injection current to the transfer sheet 81 by the attraction charging brush 10*a*.

Figure 33:
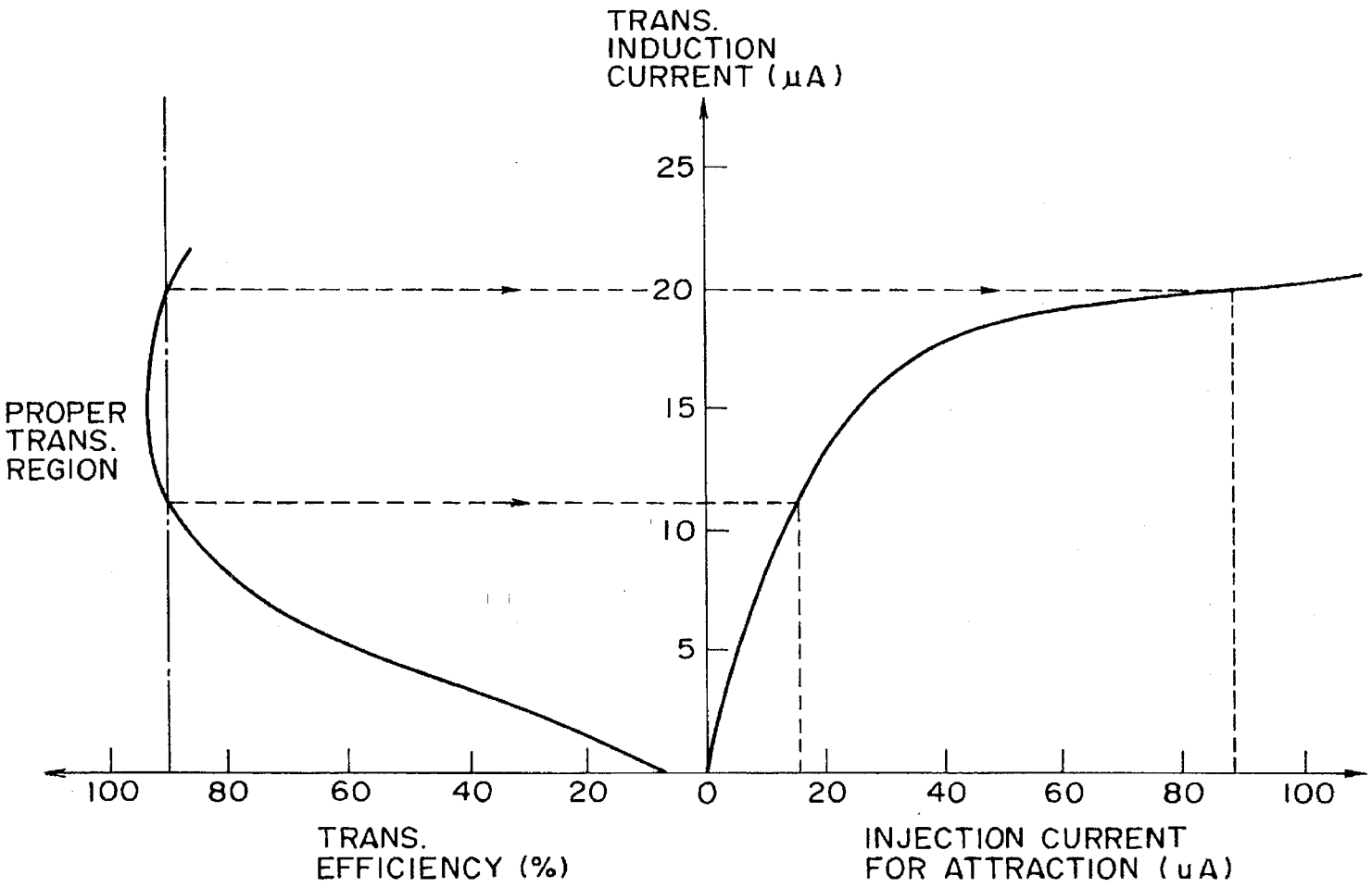
FIG. 33 is a graph showing a relationship among an attraction injection current, a transfer induced current and a transfer efficiency in the seventh embodiment.

This relation is determined through experiments. FIG. 33 shows the results in a bi-quadrant graph. The right side part of the graph shows a relation between the attracting injection current and an induced current of the transfer charging brush. The left portion thereof shows a relation between the induced current and the transfer efficiency. Generally, a transfer efficiency not less than 90% is deemed as proper transfer, and therefore, the region providing such a transfer efficiency is deemed as a proper transfer region.

From these relationships, the injecting current at the time of the attraction is understood as being proper if it is 18–88 μA.

Figure 34:
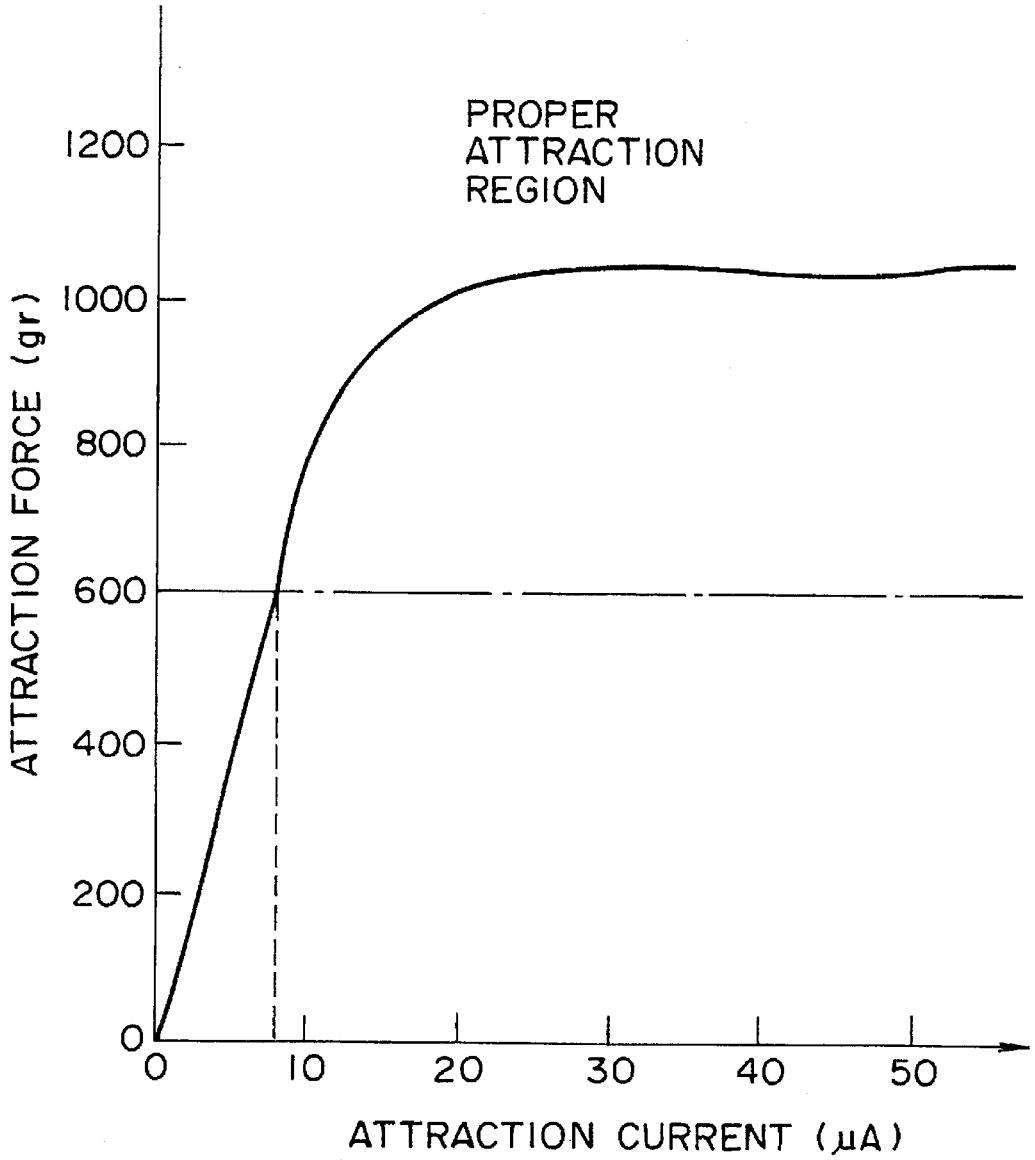
FIG. 34 is a graph showing a relationship between an attraction injection current and an attraction force between a recording material and a transfer sheet.

On the other hand, in the attraction process, the recording material is attracted. FIG. 34 shows results of experiments relating to the relation between the attraction injecting current and the attraction force. Here, the attraction force is the attraction force between an A4 size sheet as the recording material 6 and the transfer sheet 81. It is known that if the attraction force is not less than 600 g, there is no deviation or rise of the recording material, and therefore, the region providing the force is deemed as the proper attracting region. As a result, it will be understood that the attraction injection current not less than 8 μA is proper.

In view of both of the polarities of the transfer and attraction, the current in the attraction is set to approx. 18 μA.

Embodiment 8

Figure 35:
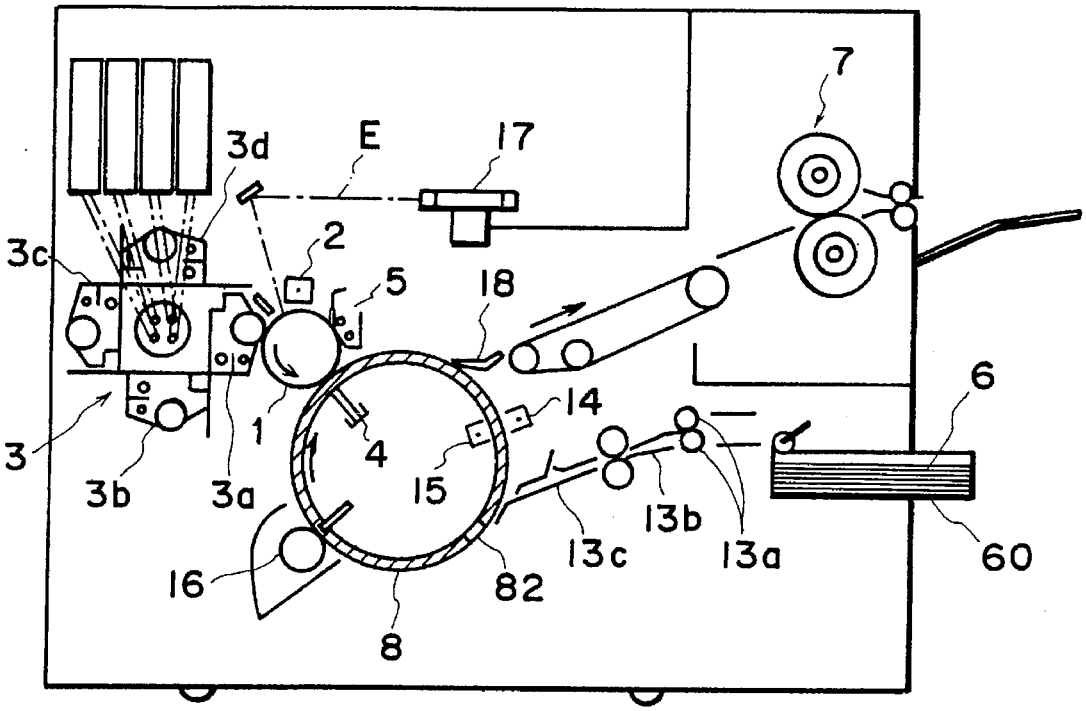
FIG. 35 is an illustration of an eighth or eleventh embodiment of an image forming apparatus of the present invention.

FIG. 35 shows an eighth embodiment of an image forming apparatus according to the present invention, in which the present invention is applied to a digital full-color electrophotographic copying machine. The copying machine is substantially the same as the apparatus of the first embodiment (FIG. 1) in the structure and operation, but the method of carrying the recording material 6 on the transfer drum 8 is different. Therefore, the description will be made mainly on the different parts. From the recording material cassette 60, the recording material 6 is fed out by the feeding roller 13*a* along the sheet guides 13*b* and 13*c*, and is pushed in the direction along the transfer drum 8 surface.

As shown in FIG. 15, the transfer drum 8 is provided with a gripper 82 for gripping the recording material 6. The leading end portion of the recording material 6 fed to the transfer drum 8 is gripped by a gripper 82 driven by a driving source (not shown). As a result, the recording material 6 is carried on the transfer drum 8 to the transfer position.

The superpose transfer operation for four colors are completed through the above-described series of operations, and thereafter, the recording material carried on the transfer drum 8 is separated from the transfer drum 8 by the separation claws 18. It is then conveyed to the fixing device 7 on a conveyer belt, so that a series of full-color printing operation is completed, and a full color print image is provided.

Figure 36:
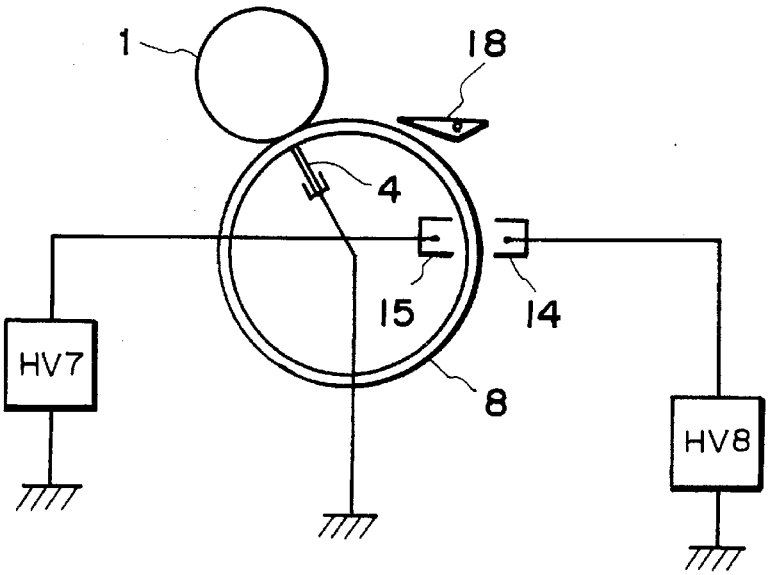
FIG. 36 is a schematic illustration of a transfer drum, a photosensitive drum and a high voltage source associated therewith or the like in the device of FIG. 35.
Figure 37:
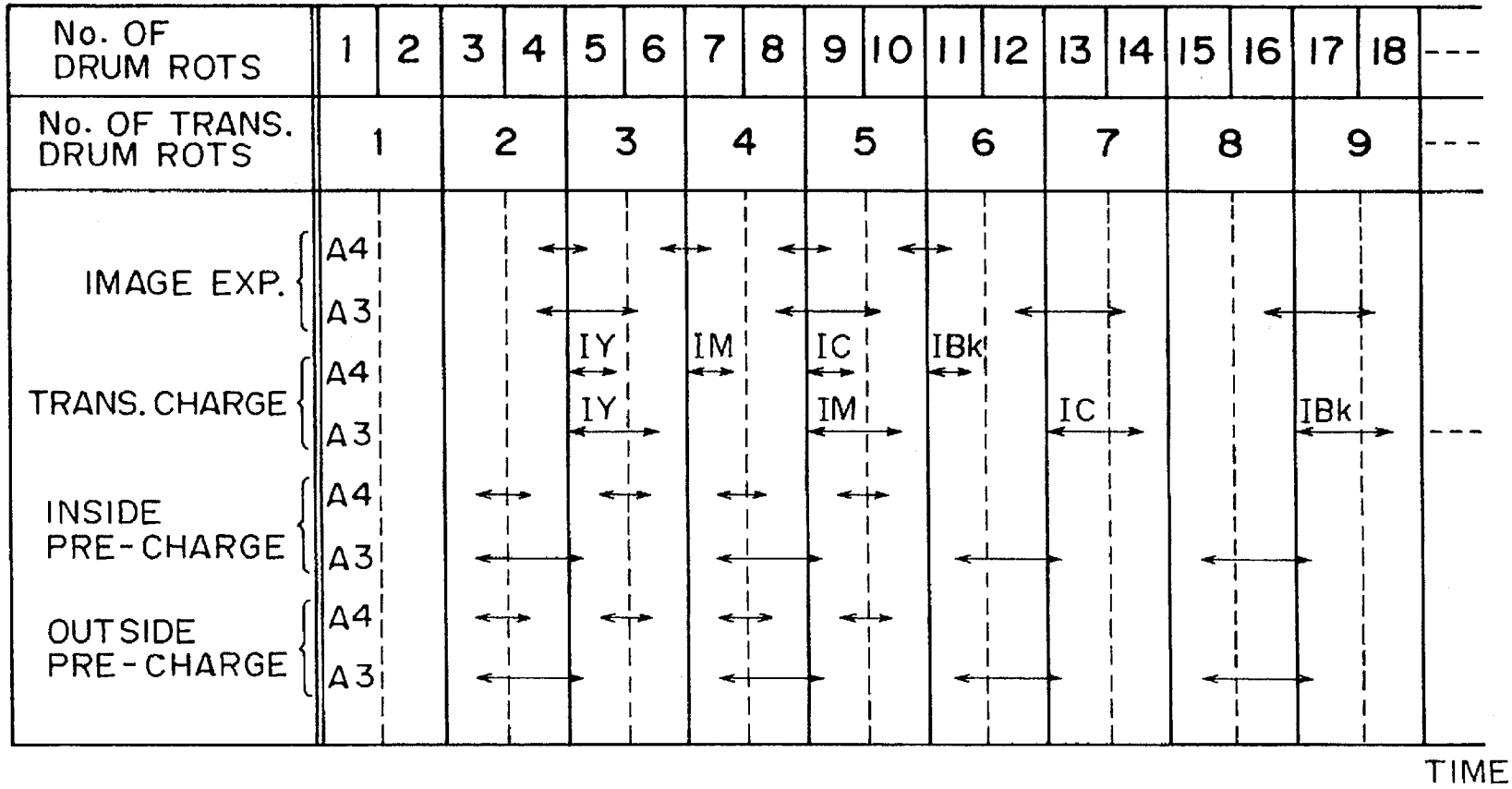
FIG. 37 is an operational timing chart of a copying machine according Go an eighth embodiment of the present invention.

FIG. 36 is a schematic illustration of the transfer drum 8, the photosensitive drum 1 and a high voltage source HV associated therewith. FIG. 37 is an operational timing chart of the copying machine. Prior to the supply of the recording material 6, a high voltage source 7 for the inside precharger and a high voltage source HV8 for the outside precharger, are operated, so that the backside of the transfer sheet 81 is charged to the negative polarity which is the same polarity as the toner, and the output of the high voltage source HV7 is −100 μA, and that of the voltage source HV8 is +100 μA.

Then, the recording material 6 is supplied to the transfer dram 8, and is gripped by a transfer drum gripper 82, and then is conveyed to the transfer position. The transfer charging brush 4 is electrically grounded. Therefore, the potential of the backside of the transfer sheet 81 is rendered approx. to 0 V. At this time, since the positive polarity (opposite from that of the toner) is induced on the backside surface of the transfer sheet, and therefore, the toner is transferred onto the recording material 6.

As a result, the negative charge on the backside of the transfer sheet 81 is reduced, but the potential is not completely 0, and the negative electric charge still remains.

The electric charge model after the first color toner transfer, is substantially the same as that shown in FIG. 30B.

Subsequently, prior to the transfer of the second color transfer, the inside precharger 15 and the outside precharger 14 operate again, by which the backside of the transfer sheet is charged again to the same polarity as a toner.

Similarly, the second, third and fourth color transfer operations are carried out.

Figure 38:
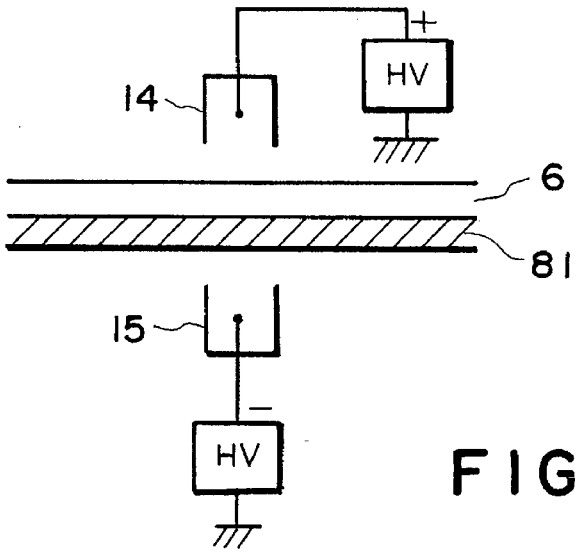
FIG. 38 illustrates an embodiment of an attraction charging means.

As shown in FIG. 38, in the eighth embodiment, the transfer precharger is in the form of a pair of corona chargers 14 and 15 in the foregoing embodiment. However, this structure is not limiting if the function of charging the backside of the transfer sheet to the negative polarity prior to each transfer operation, and the function of charging the outside (recording material side) with non-contact (if contacted, the toner image will be disturbed), a satisfied.

Figure 39:
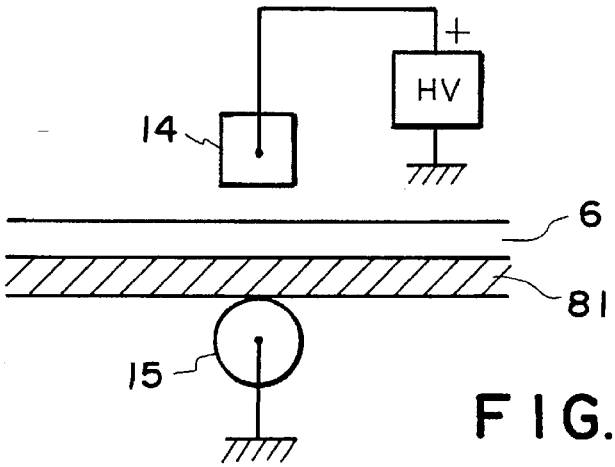
FIG. 39 illustrates an attraction charging means according to a further embodiment.
Figure 40:
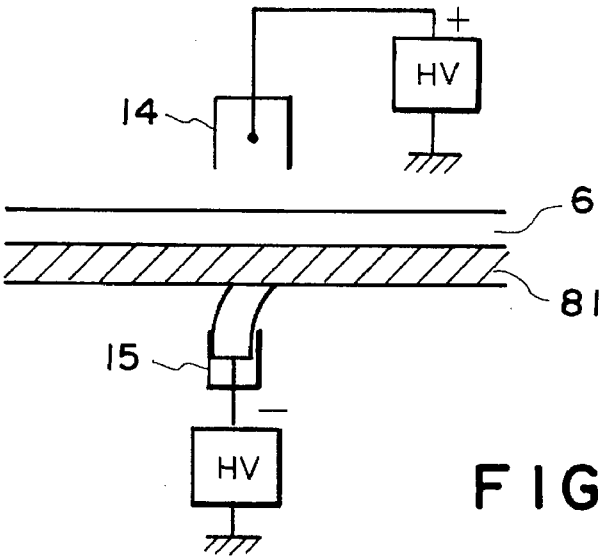
FIG. 40 illustrates an attraction charging means according to a further embodiment.

For example, the structures shown in FIGS. 39 and 40 are usable wherein a conductive roller or a conductive brush is disposed at the transfer sheet 81 side.

Embodiment 9

Figure 41:
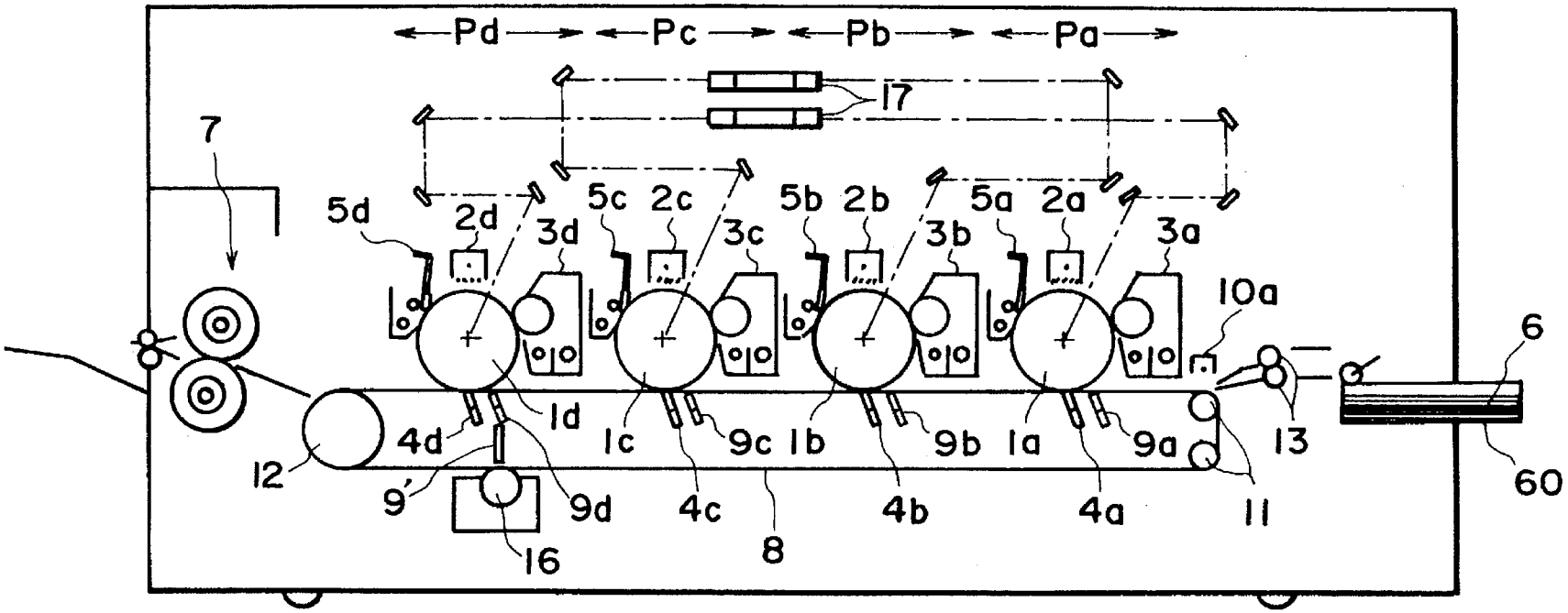
FIG. 41 is a schematic illustration of an image forming apparatus according to a ninth embodiment of the present invention.

FIG. 41 shows an image forming apparatus according to a ninth embodiment of the present invention. It is a digital full-color electrophotographic copying machine provided with four photosensitive drums similarly to the full-color electrophotographic copying machine shown in FIG. 18. The operation of this copying machine will be described.

The apparatus of this embodiment is different from FIG. 18 embodiment apparatus only in the transfer station, and therefore, the description will be made mainly in this respect. The recording material is conveyed to the transfer belt 8 from a registration roller 13. On the other hand, the transfer belt 8 is charged to the same polarity as the toner by the pre-transfer charging brush 9*a*. A toner image on the transfer drum 1*a* is transferred onto the recording material 6 under the action of the transfer charging brush 4*a*. The recording material 6 is conveyed to the second, third and fourth image forming stations Pb, Pc and Pd. Similarly, it is subjected to the precharging operation by the transfer precharging brushes 9*b*–9*d*, and thereafter, the toner images are superposedly transferred from the photosensitive drums 1*b*, 1*c* and 1*d* under the action of the transfer charging brushes 4*b*–4*d*.

Figure 42:
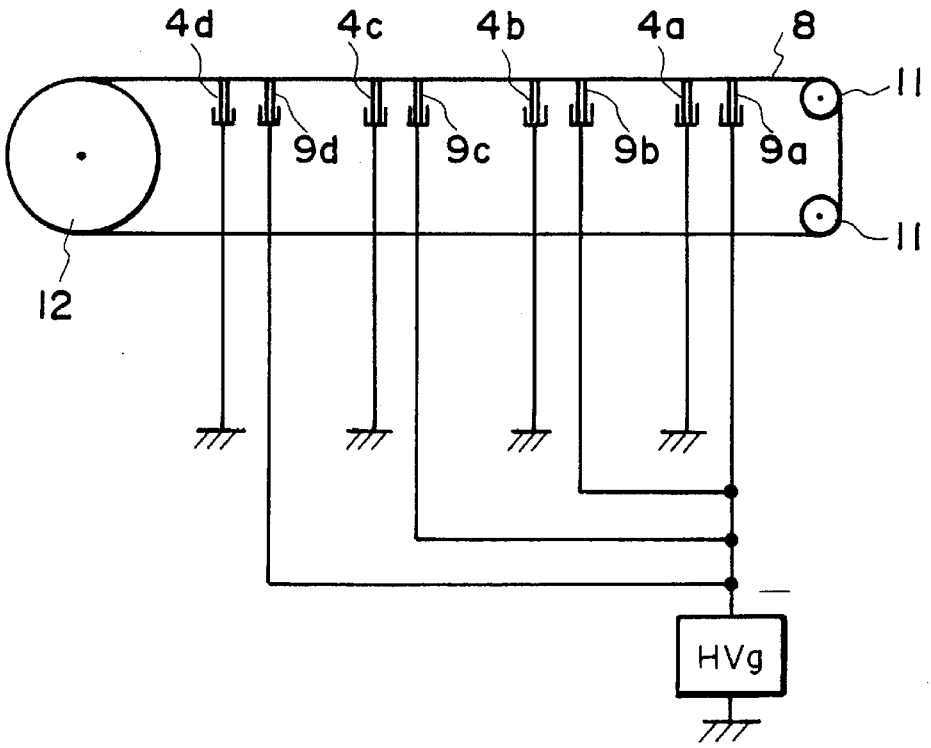
FIG. 42 is a schematic illustration of a transfer belt, a photosensitive drum and a high voltage source associated therewith or the like usable with the device of FIG. 41.

FIG. 42 is a schematic illustration of the transfer belt 8 and the high voltage source HV associated therewith, for the copying machine of FIG. 41.

When the main assembly of the copying operation starts its operation, the high voltage source HVg connected to the pre-transfer charging brushes 9*a*–9*d*, starts to operate. The high voltage source HVg is a constant voltage source in this embodiment, and supplies the electric current until a predetermined voltage is reached. The set voltage is −3 KV. By the transfer precharging operation, the potential of the backside of the transfer belt 8 coming into the transfer position comes to have a negative potential (the same polarity as the toner).

When the recording material 6 is placed on the transfer belt 8, and it is brought into the first transfer zone, the transfer charging brush 4*a* grounded functions to transfer the first color Y (yellow) toner. Similarly to the foregoing two embodiments 7 and 8, this is because an induced current flows in the transfer charging brush 4*a* to neutralize the negatively charged transfer belt.

Similarly, the second to fourth transfer operations are completed, and thereafter, the recording material is separated from the transfer belt 8.

Figure 43:
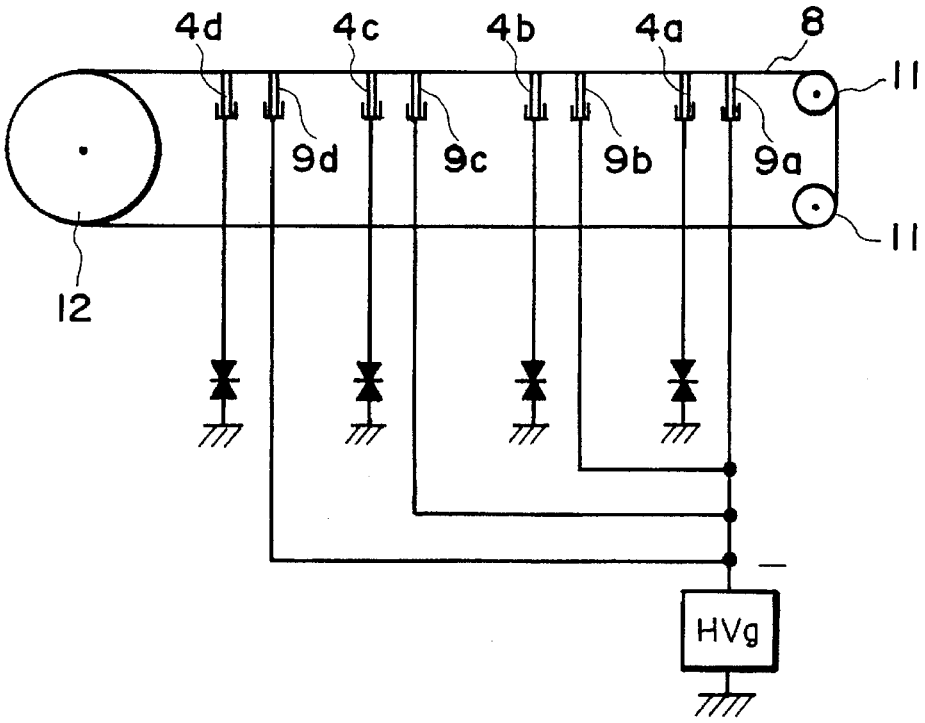
FIG. 43 is a schematic illustration of a transfer belt, a photosensitive drum and a high voltage source associated therewith for the device of FIG. 41.

In this embodiment, the transfer charging brushes 4*a*–4*d* are directly grounded, but, as shown in FIG. 43, they may be grounded through impedance elements such as varistors.

As described in the foregoing, in the image forming apparatus of this invention using an induced current transfer method (TRIC, transfer by induced current), the number of high voltage sources can be reduced as compared with the conventional device, and therefore, the cost can be reduced. In addition, the charged potentials of the recording material carrying member such as the transfer sheet or the belt can be reduced to very low level, and therefore, the toner scattering or the like in the transfer action can be suppressed. Furthermore, PET, PC or another high resistance sheet or belt is usable as the recording material carrying member, and therefore, the range of usable material is expanded.

In the image forming apparatus according to the seventh, eighth or ninth embodiment, the charging means located upstream of the transfer means disposed at the transfer position, charges such a side of the recording material carrying member as is opposite from the recording material carrying source coming into the transfer position, to the polarity which is the same as that of the toner image, prior to the toner image transfer and for each of the transfer operations. In the 10–13 embodiments which will be described hereinafter, the charging means charges the surface of the recording material not carrying the recording material coming into the transfer position, to the polarity which is the same as the toner image, prior to the first transfer of the toner image.

Embodiment 10

The image forming apparatus according to the tenth embodiment of the present invention, is usable in the digital full-color electrophotographic copying machine shown in FIG. 28 (seventh embodiment).

Figure 44:
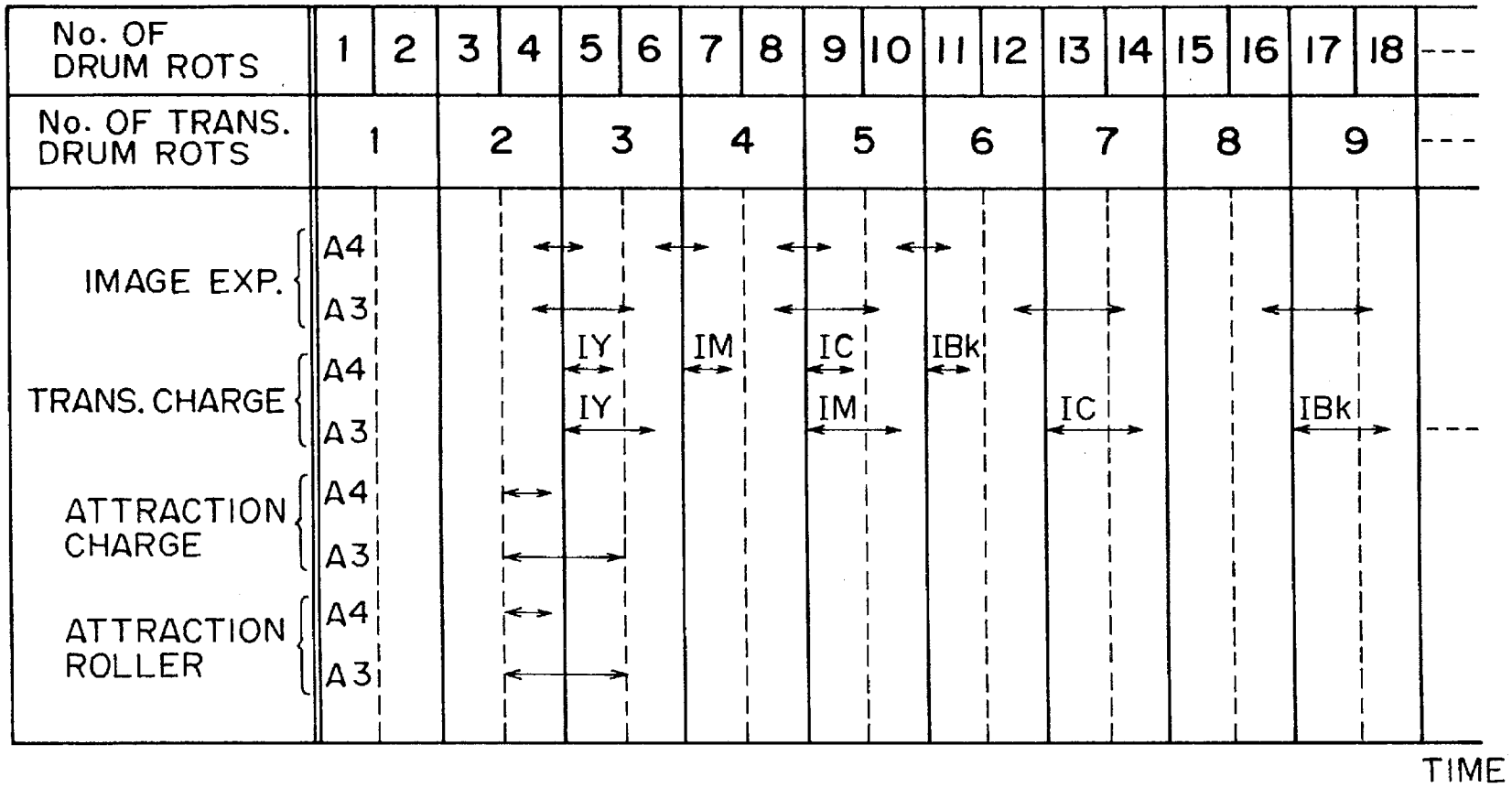
FIG. 44 is an operational timing chart of a copying machine according to a tenth embodiment.

In this embodiment, the structure of the transfer drum 8, the photosensitive drum 1 and the associated high voltage source HV for the copying machine, is the same as in FIG. 28. FIG. 44 is a operational timing chart of the copying machine of this embodiment.

Figure 45A:
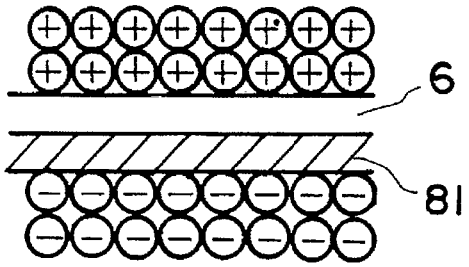
FIGS. 45A, 45B, 45C, 45D and 45E illustrate a charge model of the recording material carrying member and the recording material in a superpose transfer type copying machine, in accordance with the copy process.

Referring to FIG. 28, in this embodiment, when the recording material 6 is fed so as to be along with the transfer drum, a DC bias is applied from the high voltage source HV1 to the attraction charging brush 10*b*. The high voltage source HV1 is in the form of a constant current transformer, and the output thereof is set to −80 μA. At this time, the attraction roller 10*b* is brought into contact to the transfer drum 8, so that the recording material 6 is pushed to the transfer sheet 81 (recording material carrying member) wrapped around the transfer drum 8. Then, the positive charge (opposite polarity from the above described bias) is induced to the surface of the recording material 6. As a result, the recording material 6 is electrostatically attracted to the transfer drum 8. The charge model at this time is shown in FIG. 45A. The transfer sheet 81 is a dielectric sheet, which, in this embodiment is a film of polycarbonate (PC) in which carbon black is dispersed. It had a thickness of approx. 150 microns and a volume resistivity of $3\times10^{16}$ ohm.cm.

Then, the first color Y (yellow) toner is transferred first to the recording material carried on the transfer sheet 81. At this time, the conductive transfer charging brush 4 is electrically grounded, and therefore, the potential of the backside of the transfer sheet 81 is substantially zero. At this time, to the backside of the transfer sheet 81, the positive charge (the opposite polarity of that of the toner) is induced, and therefore, the toner is removed from the photosensitive drum 1 and is attracted to the recording material 6.

As a result, the negative charge of the backside of the transfer sheet 81 is reduced through such a phenomenon. However, the potential is not completely zero, but the negative charge rich state still continues.

Figure 45B:
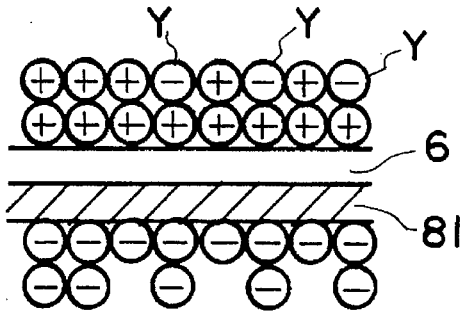

The electric charge model after the first color Y transfer, is shown in FIG. 45B. Similar manner, the second, third and fourth color transfer operations which consume the negative charge on the backside of the transfer sheet 81 applied in the initial stage, are sequentially carried out.

Figure 45C:
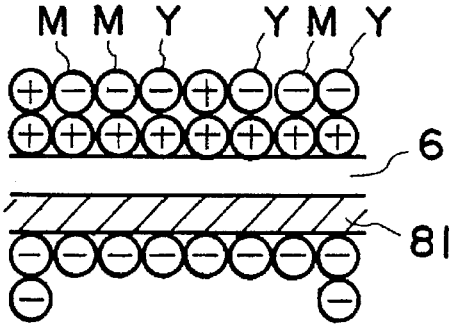
Figure 45D:
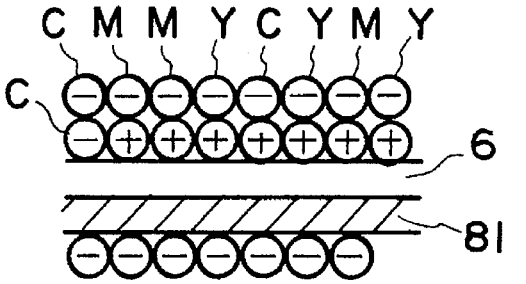
Figure 45E:
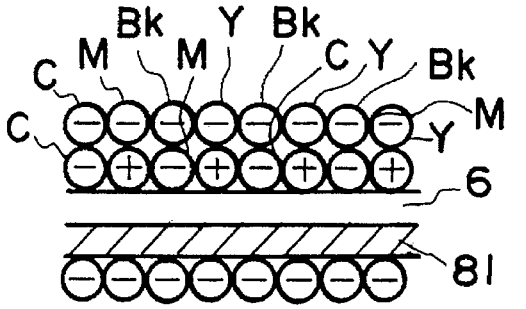

The electric charge model after the second color transfer, after the third color transfer and after the fourth color transfer, are shown in FIGS. 45C, 45D and 45E.

The recording material which has been subjected to the transfer of the toner image of four colors, is separated from the transfer drum 8 by the claws 18. Furthermore, in the case of the continuous mode copying operation, the next recording material 6 is fed immediately, and the operation therefor is the repetition of the above-described operation.

Figure 46:
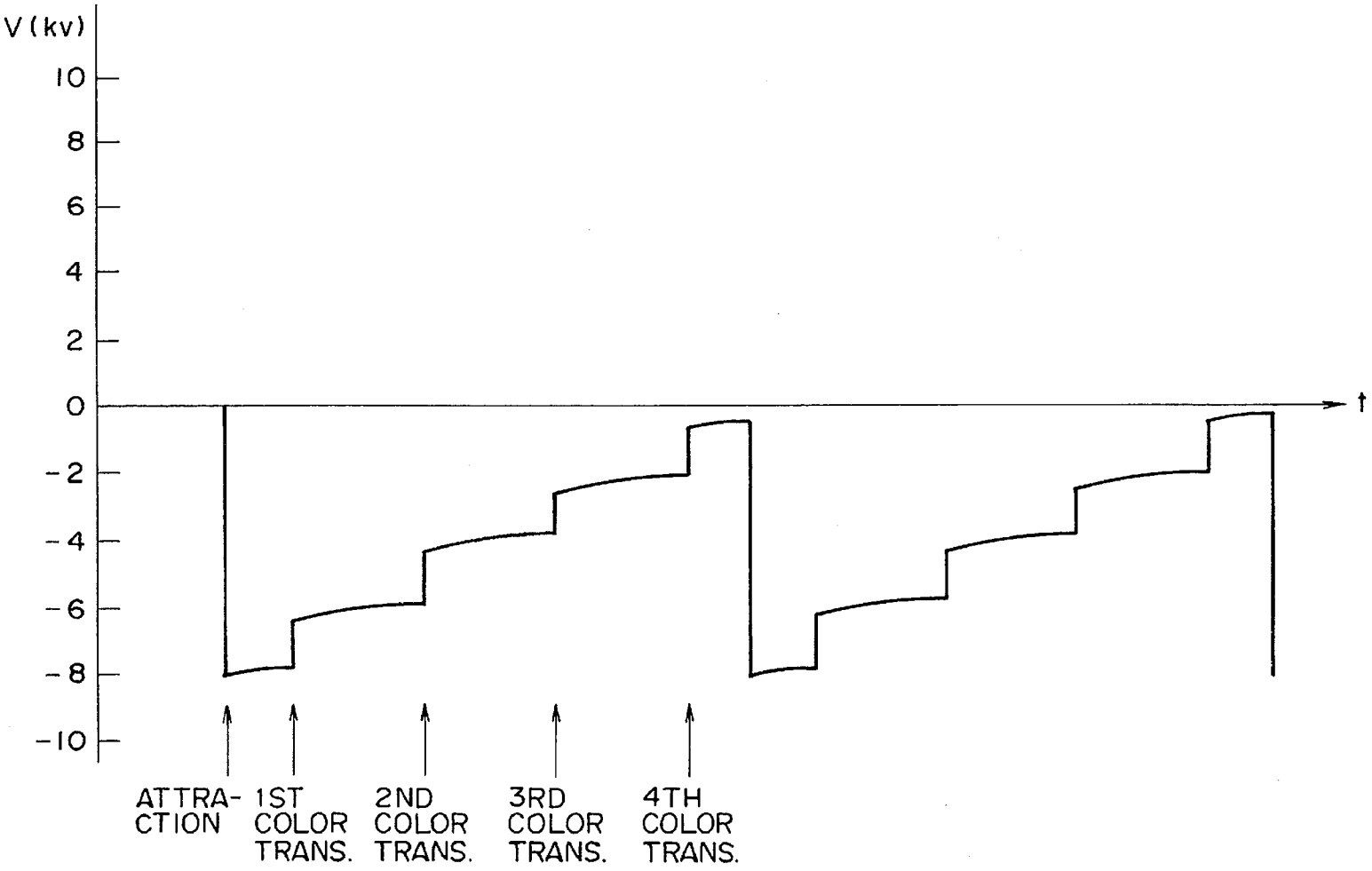
FIG. 46 illustrates a change of a surface potential of the backside of a transfer belt.

The inventors have measured the surface potential of the backside of the transfer sheet 81 using the measuring device shown in FIG. 31. The results of measurement of the surface potential of the backside of the transfer sheet 81 in the copying operation are shown in FIG. 46.

The transfer sheet 81 is charged approximately to −8.0 KV after the attraction charge. After the transfer operation, the potential decreases about 1.8 KV, respectively, toward 0, as will be understood. The reason why the potential change is dull, is that the electric charge on the backside of the transfer sheet spontaneously leaks.

Thus, by significantly charging the backside of the transfer sheet 61 by the attraction charging to the polarity which is the same as that of the toner, all of the four color toner images can be transferred only by the induced current without application of high voltage during the transfer.

In this embodiment, the structure of the attraction charging means may be those shown in FIGS. 6–9 in place of that disclosed in FIG. 5. The transfer efficiency is determined by the potential of the transfer sheet 81 at the time of its entering into the transfer position. The potential of the transfer sheet 81 is determined by the injection current into the transfer sheet by the attraction charging brush 10*a*.

Figure 47:
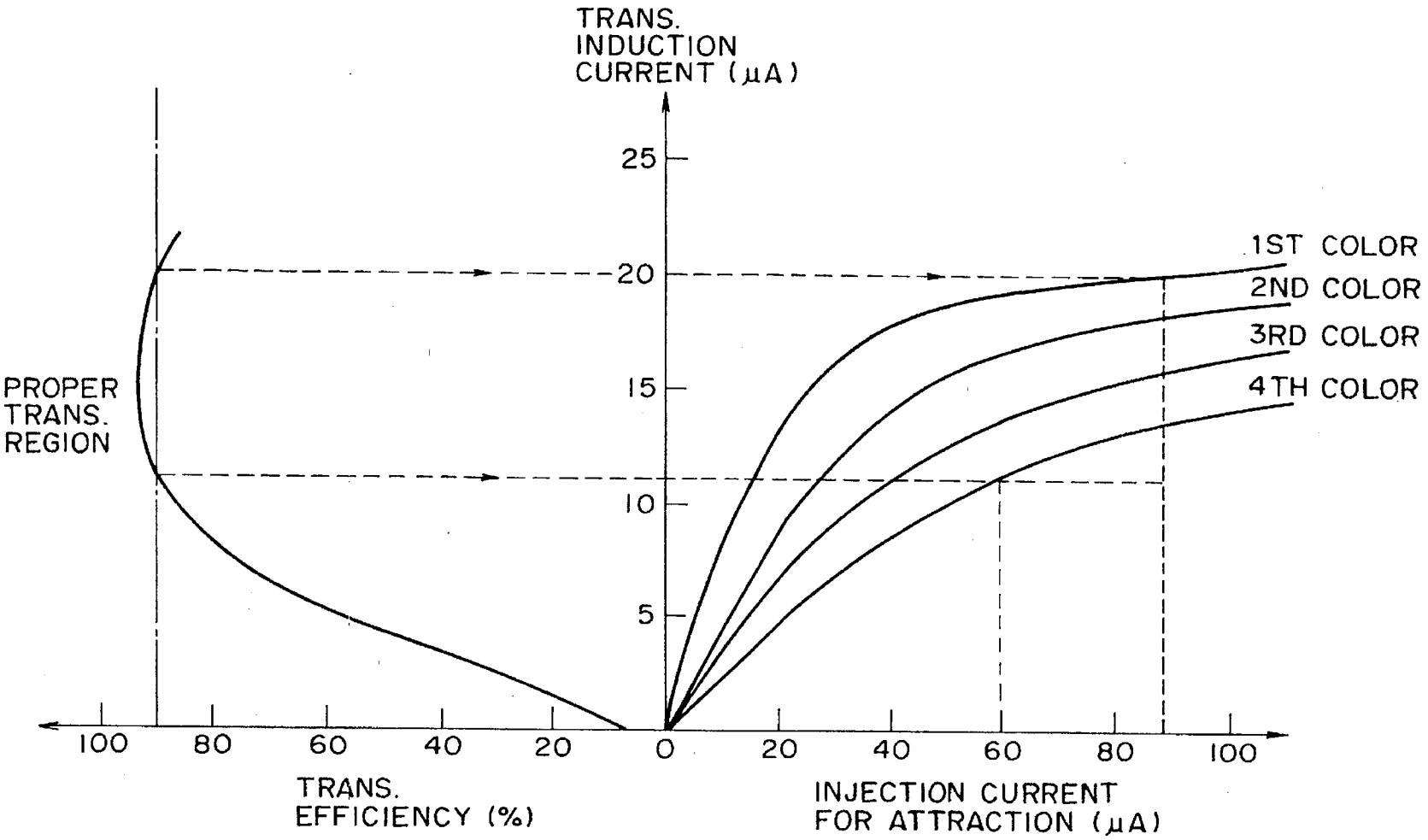
FIG. 47 is a graph of a relationship among an attraction injection current, a transfer induced current, a transfer efficiency, in the tenth embodiment.

The relationship has been determined through the experiments. The results are shown in the bi-quadrant graph in FIG. 47. Right part of the graph shows the relation between the attraction injection current and the induced current of the transfer charging brush, and the left side shows a relation between the induced current and the transfer efficiency. Generally, the transfer efficiency not less than 90% is deemed as proper transfer, and therefore, the proper transfer region is determined on the basis of such a transfer efficiency.

This graph shows that the amount of the induced current decreases toward the later color. The attraction injection current range capable of providing proper transfer from the first color to the fourth color, is approx. −60—88 μA.

On the other hand, in the attraction charging process, the recording material 6 is attracted, and therefore, as described in conjunction with FIG. 34, if the attraction force is no less than 600 g, the recording material does not rise or deviate.

Therefore, such a region is deemed as the proper attraction region, and therefore, it is preferable that the attraction injection current no less than 8 μA is preferable, as will be understood. In this embodiment, in view of the properties of the transfer and attraction, the set current for the attraction is approx. −80 μA.

Embodiment 11 in embodiment 10, the triboelectric charge amounts of the toners in the developing devices of the rotary developing apparatus 3, namely, the yellow developing device 3*a*, the magenta developing device 3*b*, the cyan developing device 3*c* and the black developing device 3*d*, are substantially the same. In this embodiment, however, the triboelectric charge amounts of the toners are different. More particularly, the developing operation proceeds in the order of the amount of triboelectricity.

The amount of the triboelectric charge is expressed by the amount of charge per unit weight.

The triboelectric charge of each of the used toners was as follows under the condition of 23° C. temperature and 60% humidity:

First color (yellow toner): 23 μC/gr

Second color (magenta toner): 20 μC/gr

Third color (cyan toner): 18 μC/gr

Fourth color (black toner): 16 μC/gr

Figure 48:
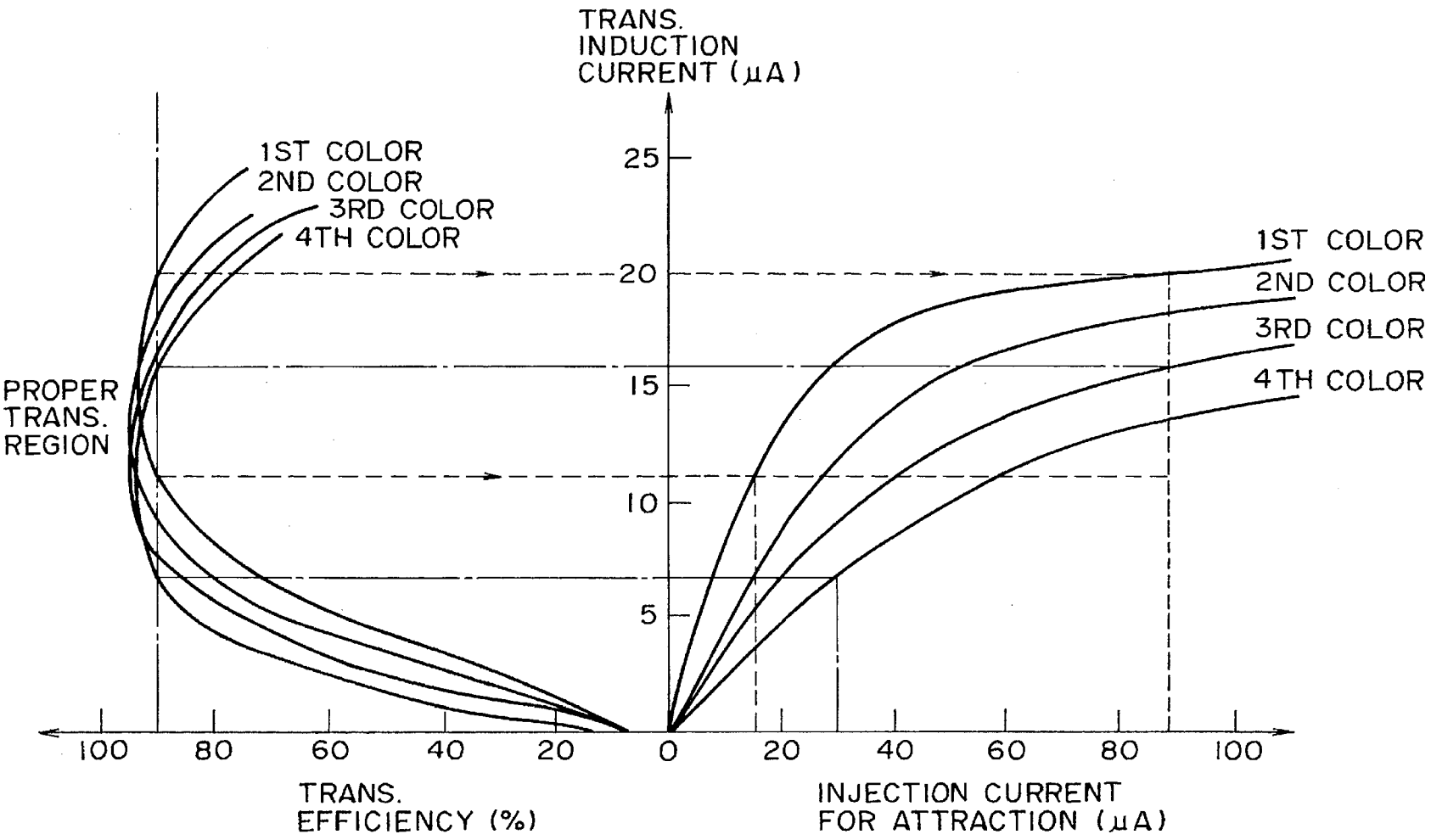
FIG. 48 is a graph showing a relationship among an attraction injection current, a transfer induced current and a transfer efficiency in the device of the FIG. 11 embodiment.
Figure 49:
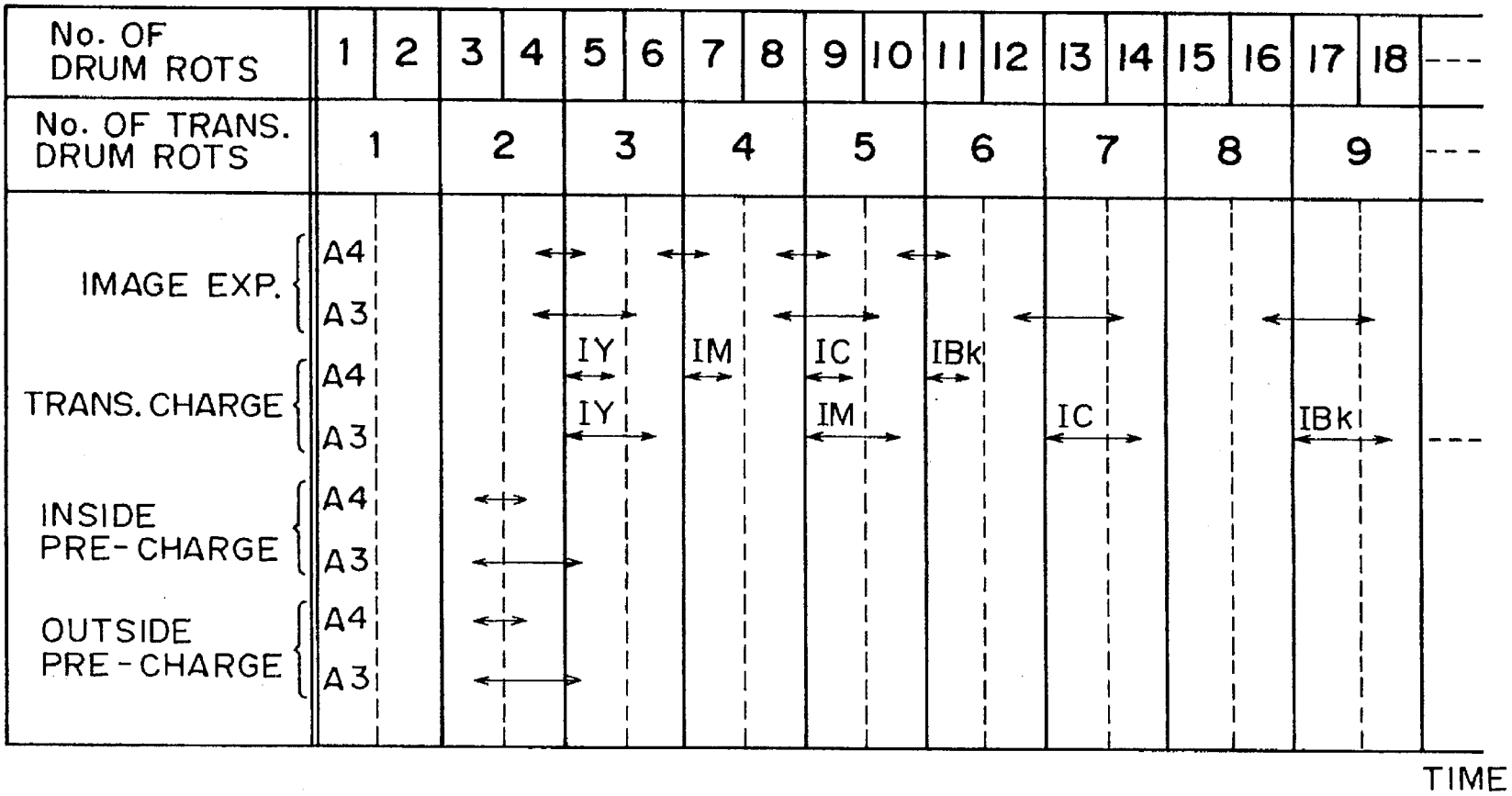
FIG. 49 is an operational timing chart of a copying machine of a twelfth embodiment.

The relationship between the transfer induced current and the transfer efficiency of each color toner is as shown in FIG. 48 in this embodiment.

It will be understood that the proper transfer is possible with low electric current if the amount of the triboelectric charge of the toner is low.

It will be also understood from the result that in this embodiment the attraction injection current capable of providing proper transfer for all of the first to fourth color toners, is approx. 30 μA and 88 μA.

In other words, in this embodiment, the larger latitude is provided as compared with the embodiment 10.

This means that the more stable transfer operations for the first to fourth colors are possible, even if, for example, the material of the recording sheet 6 is changed, or even if the degree of the charge retention at the time of the attraction charge changes due to the ambient condition change.

Embodiment 12

Referring to FIG. 35 which has been described hereinbefore, a twelfth embodiment of the image forming apparatus of this invention will be described. In this embodiment, the present invention is applied to a digital full color electrophotographic copying machine. The copying machine is substantially the same in the structure and the operation as embodiment 8. However, the method of carrying the recording material on the transfer drum 8 is different, and therefore, the description will be made as to the operation particularly on the different points.

The structure of the transfer drum 8, the photosensitive drum 1 and the high voltage source HV associated therewith, are the same as those in FIG. 36 embodiment. An operational timing chart of the copying machine is shown in FIG. 32.

Prior to the feeding of the recording material 6 the high voltage source HV7 for the inside precharger and the high voltage source 8 for the outside precharger, are operated, so that the backside of the transfer sheet 81 is charged to the negative polarity which is the same as that of the toner, and that the front surface thereof is charged to the positive polarity which is the opposite from that of the toner. The output of the high voltage source in this embodiment is −500 μA for the voltage source HV7 and +500 μA for the voltage source HV8.

Then, the recording material 6 is supplied to the transfer drum, and is gripped by a transfer drum gripper 82, and then is conveyed to the transfer position. Since the transfer charging brush 4 is electrically grounded, the backside potential of the transfer sheet 81 is rendered to substantially 0 potential. At this time, to the backside of the transfer sheet, the positive charge (opposite from that of the toner) is induced, and therefore, the toner is transferred onto the recording material 6. As a result, the negative charge on the backside of the transfer sheet 81 is reduced through such phenomenon, but the potential does not become completely 0, and the negative charge still remains.

The charge model after the first color toner transfer is the same as shown in FIG. 45B in the foregoing embodiment.

Similarly, the second color toner and third color toner and the fourth color toner are transferred.

In the foregoing description, as shown in FIG. 38, a couple of corona dischargers 14 and 15 are used. However, in the embodiment 12, the transfer precharge may have the structure shown in FIGS. 19 and 20 namely, a conductive roller or conductive brush may be disposed at the transfer sheet 81 side.

Embodiment 13

Figure 50:
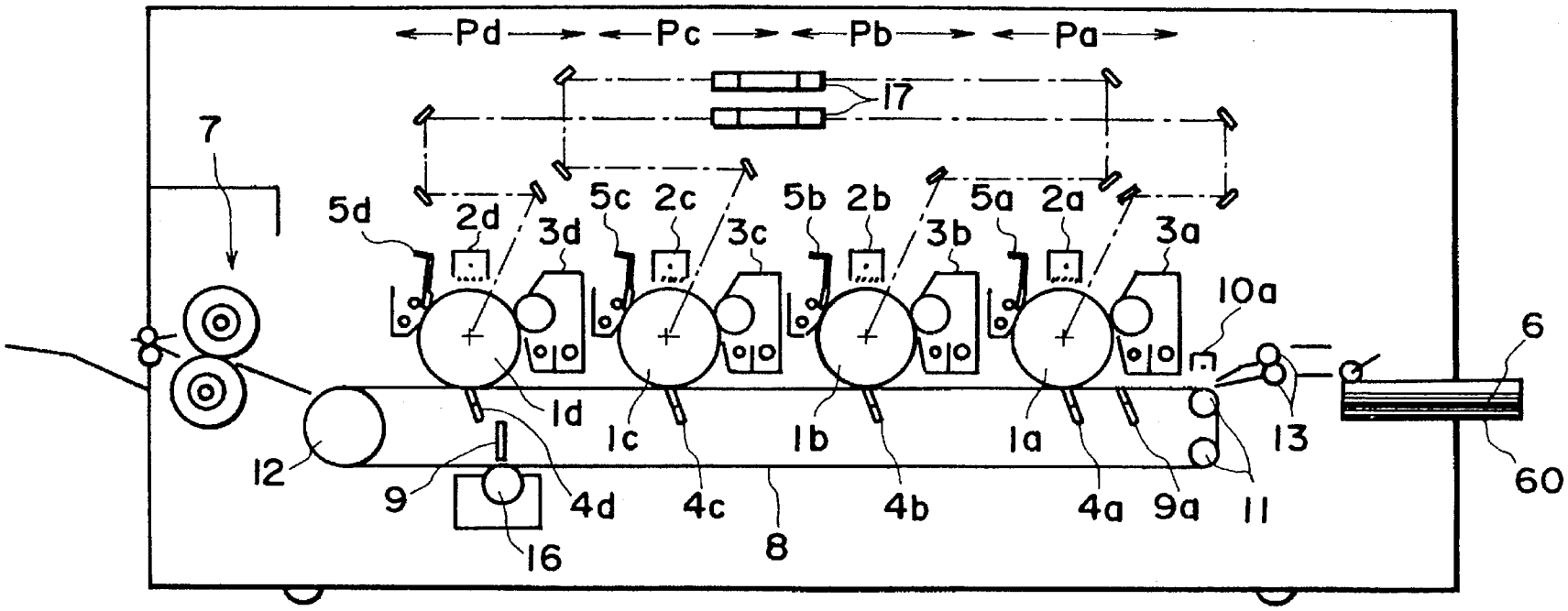
FIG. 50 illustrates an image forming apparatus according to a 13th embodiment.

FIG. 50 shows a 13th embodiment of the image forming apparatus according to the present invention. It is in the form of a digital full color electrophotographic copying machine having four photosensitive drums as in the full color electrophotographic copying machine shown in FIG. 41. The operation of the copying machine will be described. The same parts in the structure and operation as in FIG. 41, are omitted for the sake of simplicity.

The recording material 6 is fed to a transfer belt 8 from a registration roller 13. On the other hand, the transfer belt 8 is charged by the precharging brush 9*a* to the polarity which is the same as the toner.

The toner image on the photosensitive drum 1*a* is transferred to the recording material 6 under the action of the transfer charging brush 4*a*. The recording material 6 is advanced through the second, third and fourth image forming stations Pb, Pc and Pd. Under the action of the transfer charging brushes 4*b*, 4*c* and 4*d*, the toner images are superposedly transferred from the photosensitive drums 1*b*, 1*c* and 1*d* onto the recording material 6.

Figure 51:
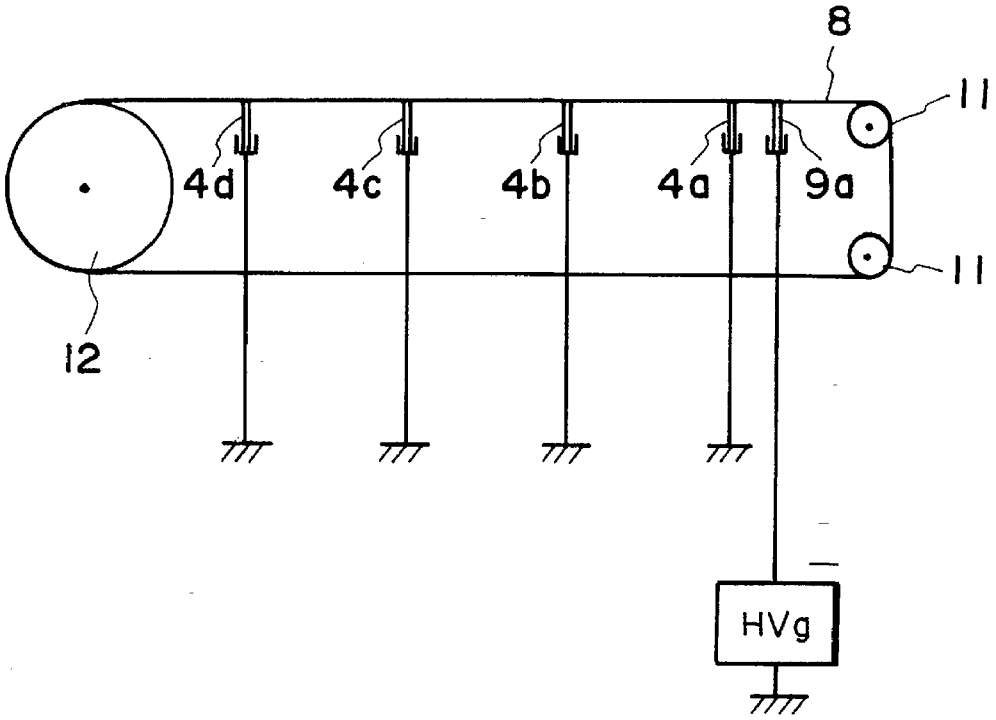
FIG. 51 is a schematic illustration of a transfer drum, a photosensitive drum and a high voltage source associated therewith or the like, in the device of FIG. 50.

FIG. 51 is a schematic illustration of the transfer belt 8 and the high voltage source associated therewith for the copying machine of FIG. 50.

When the main assembly of the copying machine starts its operation, the high voltage source HVg starts its operation. In this embodiment, the high voltage source HVg is a constant current voltage source, and the electric current flows until a preset voltage is reached. The preset level was −8 KV. The backside potential of the transfer belt entering the transfer region has been charged to a negative potential (the same polarity as a toner) by the transfer precharge.

When the recording material 6 is carried on the transfer belt, it is fed to the first transfer zone. By the grounded transfer charging brush 4*a*, the first color Y (yellow) toner is transferred. Similarly to the foregoing two embodiments, this is because the induced current flows through the transfer charging brush 4*a* to neutralize the negatively charged transfer belt 8 similarly, second, third and fourth color toners are transferred, and then, the recording material is separated from the transfer belt 8.

Figure 52:
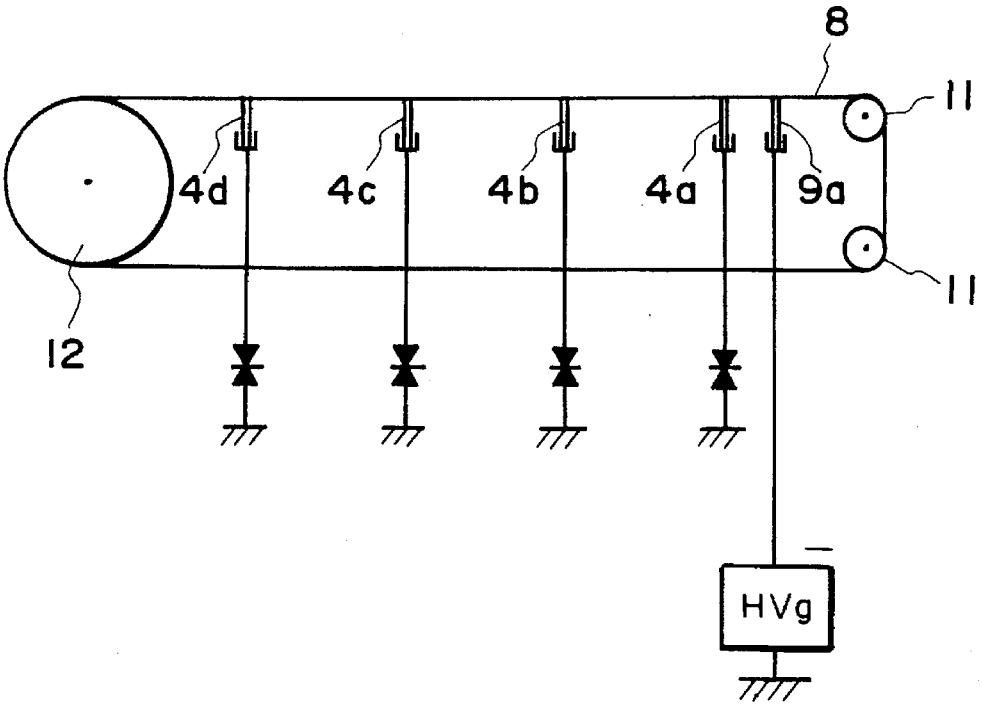
FIG. 52 illustrates another example of a transfer drum, a photosensitive drum and a high voltage source associated therewith or the like, usable with the device of FIG. 50.

In this embodiment, the transfer charging brushes 4*a*–4*d* are directly grounded. However, as shown in FIG. 52, they may be grounded through impedance elements such as varisters, by which the transfer currents for the respective colors are more uniform, with the result of very good transfer operation.

As described in the foregoing, the image forming apparatuses uses the induced current transfer method (TRIC, Transfer by Induced Current) as described in conjunction with embodiments 10–13, and therefore, the number of high voltage sources can be reduced. Accordingly, the cost can be decreased. In addition, the charge potential of the recording material carrying member such as the transfer sheet or transfer belt can be limited to the very low level. Therefore, the proper transfer operation without toner scattering is possible.

Furthermore, the material of the recording material carrying member may be PET, PC or the like having a high resistance is usable, so that the range of the material selection is expanded. As described in the foregoing, the charging means for effecting charging prior to the transfer operation is constituted by a pair of corona dischargers or electrically conductive contacting elements which sandwiches the recording material or sandwiches the recording material and the recording material carrying member, and which are disposed faced to each other, and at least one of them is connected to a high voltage source providing a DC high voltage or an AC biased DC high voltage source.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image;

movable recording material carrying means for carrying a recording material in a movable direction, said movable recording material carrying means being charged to different potentials along the movable direction;

potential applying means for applying a potential of the same polarity as that of the toner image to an area on a backside of said movable recording material carrying means;

transfer charging means for supplying electric current to the same area on the backside of said movable recording material carrying means to which potential applied by said potential applying means is retained, wherein said transfer charging means is located at a position along the movable direction of said recording material carrying means which is different from that of said potential applying means, and wherein the electric current is supplied so as to transfer the toner image borne on said image bearing member onto the recording material carried on said movable recording material carrying means; and control means for controlling the electric current supplied from said transfer charging means to said movable recording material carrying means to be a predetermined level.

2. An apparatus according to claim 1, wherein different color toner images are sequentially superposedly transferred onto the recording material carried on said recording material carrying means.

3. An apparatus according to claim 2, wherein said potential applying means applies the potential prior to a first transfer operation, and does not apply the potential between transfer operations in the sequential transfer.

4. An apparatus according to claim 2, wherein said potential applying means applies the potential prior to each transfer operation of the sequential transfer operations.

5. An apparatus according to claim 4, wherein, during the sequential transfer operations, the potential on the backside of the recording material carrying means changes from the same polarity to the opposite polarity as that of the toner.

6. An apparatus according to claim 2, further comprising plural such image bearing members on which different color toner images are formed, and wherein each of the different color toner images are sequentially and superposedly transferred onto the recording material carried on said recording material carrying means.

7. An apparatus according to claim 2 or 6, wherein said apparatus forms a full color toner image.

8. An apparatus according to claim 1, wherein said transfer charging means is contactable to the backside of the recording material carrying means.

9. An apparatus according to claim 8, wherein said transfer charging means is comprised by a brush.

10. An apparatus according to claim 1, wherein said transfer charging means includes a corona charger having a wire and a shield, and said control means controls a current difference between a current flowing into the wire and a current flowing into the shield, to be a predetermined level.

11. An apparatus according to claim 1, wherein said potential applying means includes a charging member contactable to the backside of the recording material carrying means.

12. An apparatus according to claim 1, wherein said potential applying means electrostatically attracts the recording material on said recording material carrying means.

13. An apparatus according to claim 1, wherein said recording material carrying means includes a dielectric material sheet.

14. An image forming apparatus comprising:

an image bearing member for bearing a toner image;

movable recording material carrying means for carrying a recording material in a movable direction, said movable recording material carrying means being charged to different potentials along the movable direction;

potential applying means for applying a potential of the same polarity as that of the toner image to an area on a backside of said movable recording material carrying means; and transfer charging means contactable to the same area on the backside of said movable recording material carrying means to which potential applied by said potential applying means is retained to transfer the toner image borne on said image bearing member to the recording material carried on said movable recording material carrying means, wherein said transfer charging means is located at a position along the movable direction of said movable recording material carrying means which is different from that of said potential applying means, and wherein said transfer charging means is electrically grounded through a constant voltage element.

15. An apparatus according to claim 14, wherein different color toner images are sequentially and superposedly transferred onto the recording material carried on said recording material carrying means.

16. An apparatus according to claim 15, wherein said potential applying means applies the potential to the backside of the recording material carrying means prior to a first transfer operation in the sequential transfer operation, and does not apply the potential between transfer operations in the sequential transfer operations.

17. An apparatus according to claim 16, wherein during the sequential transfer operations, the potential of the backside of the recording material carrying means is maintained to have the same polarity as that of the toner image.

18. An apparatus according to claim 15, wherein said potential applying means applies the potential to the backside of the recording material carrying means prior to each of the transfer operations of the sequential transfer operations.

19. An apparatus according to claim 18, wherein during the sequential transfer operations, the potential of the backside of the recording material carrying means is maintained to be the same polarity as that of the toner image.

20. An apparatus according to claim 19, further comprising plural such image bearing members on which different color toner images are formed, and wherein each of the different color toner images are sequentially and superposedly transferred onto the recording material carried on said recording material carrying means.

21. An apparatus according to claim 19 or 23, wherein said apparatus forms a full color toner image.

22. An apparatus according to claim 14, wherein said transfer charging means is comprised by a brush.

23. An apparatus according to claim 14, wherein said potential applying means comprises a charging member contactable to the backside of the recording material carrying means.

24. An apparatus according to claim 14, wherein said potential applying means electrostatically attracts the recording material on said recording material carrying means.

25. An apparatus according to claim 14, wherein said recording material carrying means includes a dielectric material sheet.

26. An apparatus according to claim 14, wherein said constant voltage element is comprised by a varistor.

* * * * *

UNITED STATES PATENT AND TRADEMARK OFFICE

CERTIFICATE OF CORRECTION

PATENT NO. : 5,659,842

DATED : August 19, 1997

INVENTORS : Takashi Hasegawa, et al.

It is certified that error appears in the above-identified patent and that said Letters Patent is hereby corrected as shown below:

COLUMN 4

Line 44, "Go" should read --to--.

COLUMN 5

Line 7, "FIG. 11" should read --Figures 11A, 11B, and 11C--.

Line 42, delete "da cyan".

Line 43, "developing 3b," should read --developing device 3b,--.

COLUMN 6

Line 50, "source VH2" should read --source HV2--.

Line 52, "source H2" should read --source HV2--.

UNITED STATES PATENT AND TRADEMARK OFFICE

CERTIFICATE OF CORRECTION

PATENT NO. : 5,659,842

DATED : August 19, 1997

INVENTORS : Takashi Hasegawa, et al.

It is certified that error appears in the above-identified patent and that said Letters Patent is hereby corrected as shown below:

COLUMN 9

Line 35, "material 6 the" should read --material 6. The--.

COLUMN 11

Line 58, "transfers" should read --transfer--.

COLUMN 13

Line 63, "fourth Bk" should read --fourth color Bk--.

COLUMN 15

Line 38, "dram 8," should read --drum 8,--.

Line 64, "a" should read --is--.

UNITED STATES PATENT AND TRADEMARK OFFICE

CERTIFICATE OF CORRECTION

PATENT NO. : 5,659,842

DATED : August 19, 1997

INVENTORS : Takashi Hasegawa, et al.

It is certified that error appears in the above-identified patent and that said Letters Patent is hereby corrected as shown below:

COLUMN 17

Line 50, "Similar" should read --In a similar--.

COLUMN 18

Line 43, "in" should read --In--.

COLUMN 19

Line 28, "source 8" should read --source HV8--;

Line 53, "precharge" should read --precharger--; and

Line 54, "20" should read --20,--.

UNITED STATES PATENT AND TRADEMARK OFFICE

CERTIFICATE OF CORRECTION

PATENT NO. : 5,659,842

DATED : August 19, 1997

INVENTORS : Takashi Hasegawa, et al.

It is certified that error appears in the above-identified patent and that said Letters Patent is hereby corrected as shown below:

COLUMN 20

Line 26, "belt 8" should read --belt 8;--;

Line 31, "varisters," should read --varistors,--; and

Line 35, "uses" should read --use--.

COLUMN 22

Line 43, "claim 19," should read --claim 15,--; and

Line 49, "claim 19 or 23," should read --claim 15 or 20,--.

Signed and Sealed this

Fourteenth Day of July, 1998

Bruce Lehman

*Attest:*

BRUCE LEHMAN

*Attesting Officer*

*Commissioner of Patents and Trademarks*